United States Patent [19]

Mizude

[11] Patent Number: 5,065,189

[45] Date of Patent: Nov. 12, 1991

[54] ELECTROPHOTOGRAPHIC COPYING MACHINE AND METHOD OF SETTING COPY MAGNIFICATION

[75] Inventor: Kazuhiro Mizude, Osaka, Japan

[73] Assignee: Mita Industrial Co., Ltd., Osaka, Japan

[21] Appl. No.: 615,176

[22] Filed: Nov. 19, 1990

[30] Foreign Application Priority Data

Nov. 27, 1989 [JP] Japan ..... 1-308108
Nov. 27, 1989 [JP] Japan ..... 1-308109

[51] Int. Cl.[5] ..... G03G 15/04
[52] U.S. Cl. ..... 355/243
[58] Field of Search ..... 355/243, 208, 55, 56, 355/57

[56] References Cited

U.S. PATENT DOCUMENTS 4,076,417 2/1978 Hayashi et al. ..... 355/55 X
4,486,092 12/1984 Ichinokawa ..... 355/208 X
4,627,708 12/1986 Arai et al. ..... 355/57 X
4,837,598 6/1989 Nonami ..... 355/218
4,843,427 6/1989 Ibuchi ..... 355/218

FOREIGN PATENT DOCUMENTS 0279839 12/1986 Japan ..... 355/56
0286867 11/1988 Japan ..... 355/55

*Primary Examiner*—A. T. Grimley
*Assistant Examiner*—Robert Beatty
*Attorney, Agent, or Firm*—Sandler, Greenblum, & Bernstein

[57] ABSTRACT

An electrophotographic copying machine and a method of setting a copy magnification. The machine includes a glass plate on which an original sheet is set, an exposure lamp for scanning the original sheet, a photoconductor, first, second and third mirrors for reflecting in turn the light reflected by the original sheet, a lens refracting the light from the third mirror for imaging on the photoconductor, a first moving frame for carrying the exposure lamp and the first mirror, a second moving frame for carrying the second and third mirrors, an inputting device for inputting a copy magnification, a setting device for setting the inputted copy magnification by moving the lens and fourth mirror system, and a driving device for moving the first and second moving frames, when the original sheet is scanned, to keep a fixed optical length from the original sheet to the lens. When a magnification larger than the copy magnification already set is newly inputted, the setting device moves the lens so as to set the new magnification after the first and second moving frames have returned to their respective home positions. According to another aspect to the invention, when the newly inputted magnification is larger than the previously inputted magnification, the lens is moved first. Also, a fourth mirror system may be first moved when the newly inputted magnification is equivalent to or smaller than the previously inputted magnification.

4 Claims, 26 Drawing Sheets

ELECTROPHOTOGRAPHIC COPYING MACHINE AND METHOD OF SETTING COPY MAGNIFICATION

BACKGROUND OF THE INVENTION

1. Field of the Invention

The present invention generally relates to an electrophotographic copying machine like a PPC and a method of setting a copy magnification in the photocopying machine.

2. Description of the Prior Art

A conventional electrophotographic copying machine comprises an optical system, a magnification setting device, an optical system shift device and a confirming device. The optical system is composed of a movable exposure lamp for scanning an original sheet, a first mirror for reflecting an image light emitted from the original sheet, second and third mirrors for further reflecting the image light from the first mirror, and an imaging lens and a fourth mirror passing the light from the third mirror for imaging on a photoconductor. The magnification setting device moves the lens and fourth mirror, individually, corresponding to an inputted magnification, for effecting the desired copy magnification. The optical system shift device moves the exposure lamp and first mirror together and the second and third mirrors together from their respective home positions to keep a fixed optical length between the face of the original sheet and the imaging lens during scanning of the original sheet, the optical length being based upon the set magnification. The confirming device is for confirming whether the exposure lamp and first mirror, and the second and third mirrors are in their respective home positions. In this way, the conventional electrophotographic copying machine, when a magnification is newly inputted, sets a copy magnification by moving the lens and the fourth mirror independent of the positions of the exposure lamp and first mirror, or the second and third mirrors in the optical system (see, for example, U.S. Pat. Nos. 4,837,598 and 4,843,427)

Although such a conventional electrophotographic copying machine is designed to limit the distance by which the original sheet can be scanned (the size of the original sheet) corresponding to the required copy magnification so that the optical system and the lens do not collide with each other, once a paper jam, for example, arises, the optical system is immediately stopped to cease the copying operation, and when a treatment for the paper jam is completed and the copying operations can be resumed, the optical system is once reset; specifically, the optical system returns to its home position, while the lens and the fourth mirror return to the positions whereby the copy magnification gets 100%. For example, assume that the copying operation is interrupted because of a paper jam when the copying machine is working with the copy magnification less than 100%, and after the copying function is recovered, the magnification is changed to enlarge the scale, and that after a service engineer, for example, tampers with the optical system, the lens is moved with the magnification set to enlarge the scale. In either case, the optical system might collide with the lens.

Moreover, assume that, in such a conventional electrophotographic copying machine, another copy magnification is newly inputted while the lens and fourth mirror are moving corresponding to the copy magnification previously inputted. If the lens and fourth mirror are immediately moved corresponding to the magnification newly inputted, the lens and fourth mirror might collide with each other. Hence, after they are once moved to the positions corresponding to the magnification previously inputted, the lens and fourth mirror should be moved to the positions corresponding to the magnification newly inputted. Thus, when the copy magnification is changed while the lens and fourth mirror are moving, there arises the problem that a long period of time is required until the setting of the magnification is completed.

SUMMARY OF THE INVENTION

The present invention provides an electrophotographic copying machine and a method of setting a copy magnification in the electrophotographic copying machine; the electrophotographic copying machine comprising a contact glass plate on which an original sheet is set, an exposure lamp for scanning the original sheet on the contact glass plate, a photoconductor, a first mirror for reflecting the light emitted from the exposure lamp and then reflected by the original sheet, in the direction contrary to the scanning direction, a second mirror for reflecting the light from the first mirror, a third mirror for reflecting the light from the second mirror in the scanning direction, a lens receiving the light from the third mirror for imaging on the photoconductor through a fourth mirror, a first moving frame movable in the scanning direction for carrying the exposure lamp and the first mirror, a second moving frame movable following the first moving frame for carrying the second and third mirrors, inputting means for inputting a copy magnification, magnification setting means for setting the inputted copy magnification by moving the lens and fourth mirror, and optical system driving means for moving the first and second moving frames from their respective home positions, when the original sheet is scanned, to keep a fixed optical length between the face of the original sheet and the lens corresponding to the copy magnification; when a magnification larger than the copy magnification already set is newly inputted, the magnification setting means moving the lens so as to set the new magnification after the first and second moving frames have returned to their respective home positions.

The present invention also provides an electrophotographic copying machine and a method of setting a copy magnification in the electrophotographic copying machine; the electrophotographic copying machine comprising a contact glass plate on which an original sheet is set, an exposure lamp for scanning the original sheet on the contact glass plate, a photoconductor, a first mirror for reflecting the light emitted from the exposure lamp and then reflected by the original sheet in the direction contrary to the scanning direction, a second mirror for reflecting the light from the first mirror, a third mirror for reflecting the light from the second mirror in the scanning direction, a lens refracting the light from the third mirror for imaging on the photoconductor through a fourth mirror, a first moving frame movable in the scanning direction for carrying the exposure lamp and the first mirror, a second moving frame movable following the first moving frame for carrying the second and third mirrors, inputting means for inputting a desired copy magnification, magnification setting means for setting the inputted magnification by moving the lens and fourth mirror, and optical system driving means for moving the first and second moving frames from their respective home positions, when the original sheet is scanned, to keep a fixed optical length from the original sheet to the lens corresponding to the copy magnification; when a magnification is newly inputted while the lens and fourth mirror are moving corresponding to the magnification already inputted, the magnification setting means moving the lens first when the magnification newly inputted is larger than the magnification previously inputted, but moving the fourth mirror first when the former is smaller than the latter.

Preferably, the fourth mirror is composed of at least two mirrors for varying an optical length from the imaging lens to the photoconductor.

According to the present invention, when the copying operation is interrupted because of a paper jam or the like and then the copying function is recovered, the optical system, the lens and the like can be reset without any problem, and further, when a magnification is newly inputted while the lens and fourth mirror are moving, the lens and fourth mirror can be immediately moved corresponding to the newly inputted magnification for effecting the desired copy magnification in a short period of time.

DETAILED DESCRIPTION OF THE PREFERRED EMBODIMENTS

Figure 1:
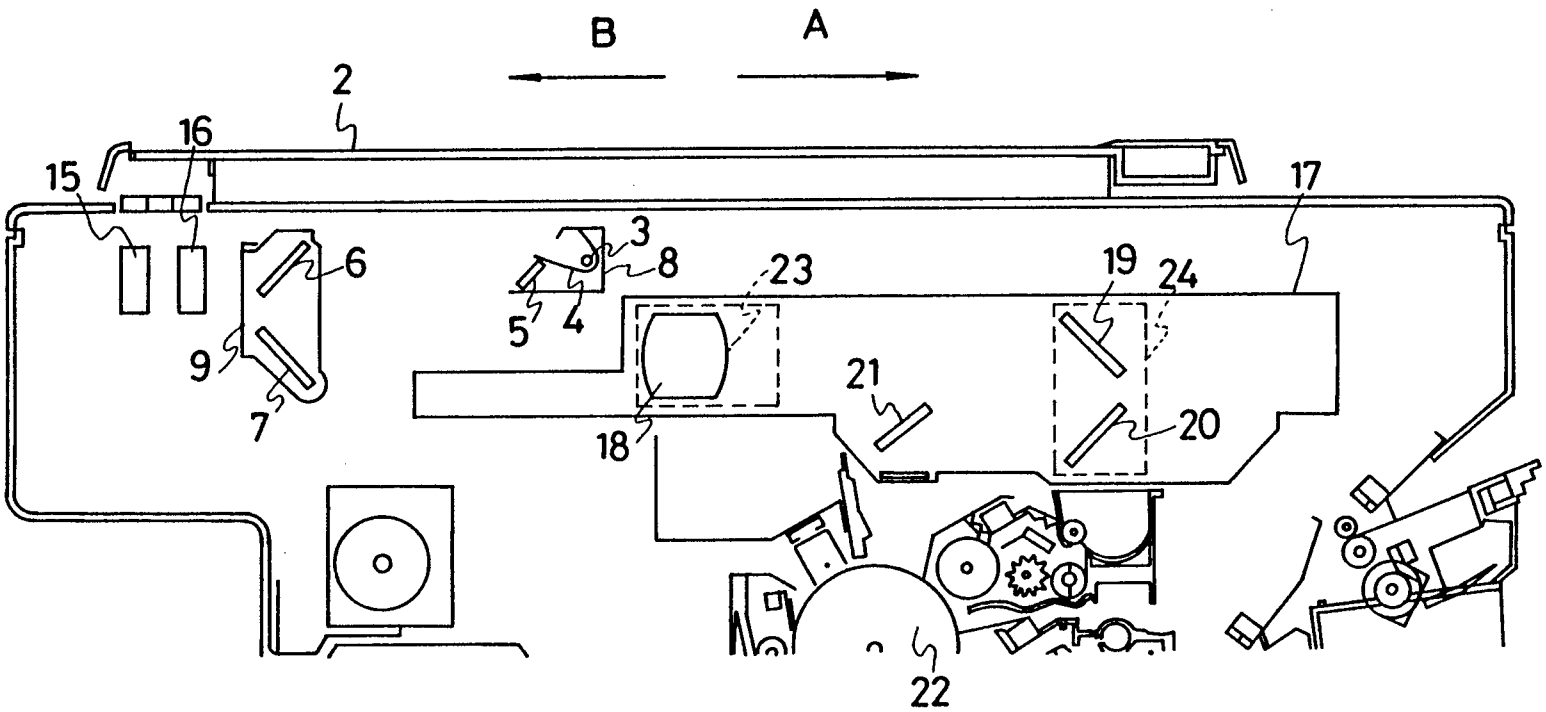
FIG. 1 is a diagram showing a structure of a main portion of an electrophotographic copying machine of an embodiment according to the present invention.
Figure 2:
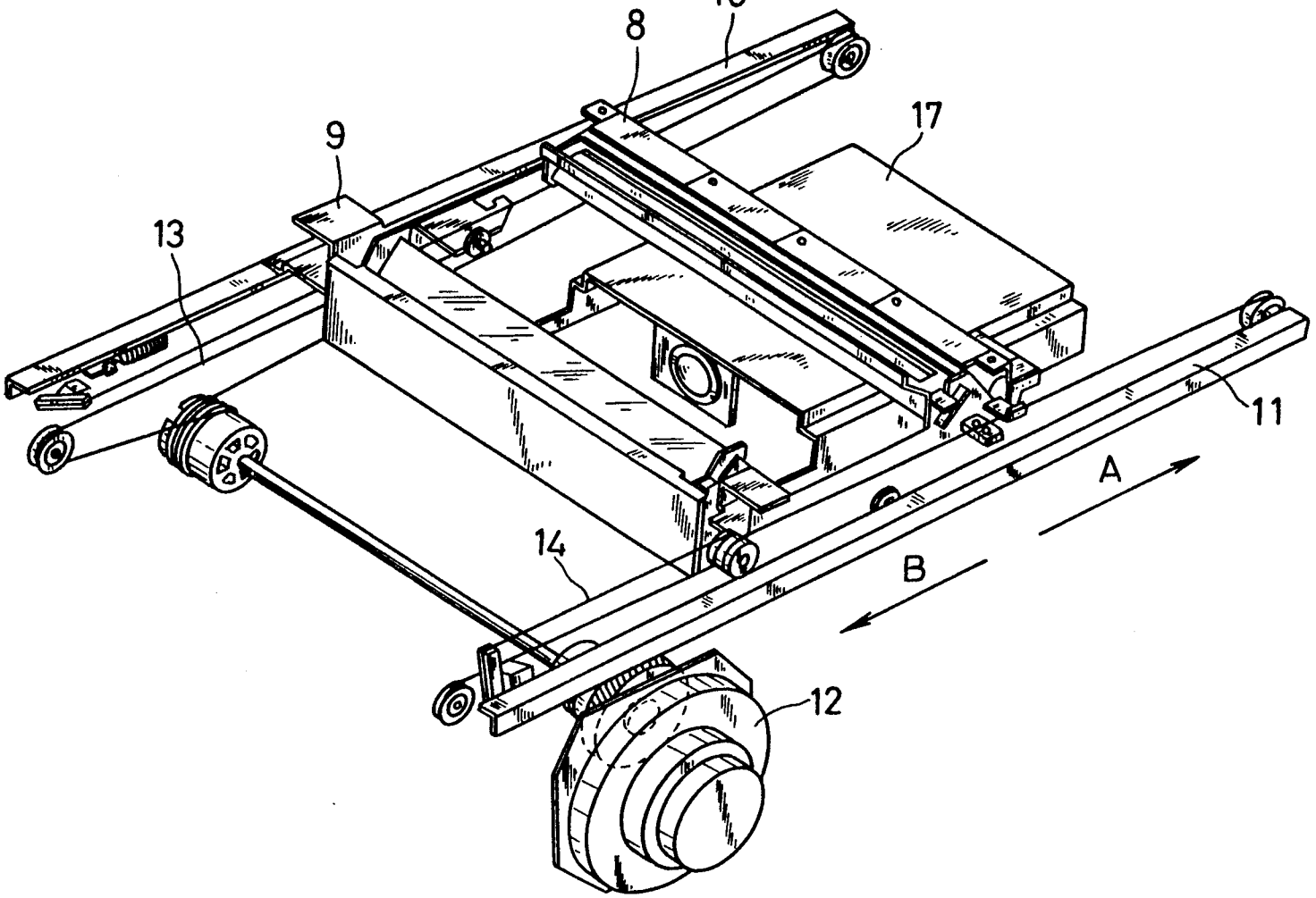
FIGS. 2 and 3 are perspective views showing the main portion of FIG. 1 in detail.
Figure 3:
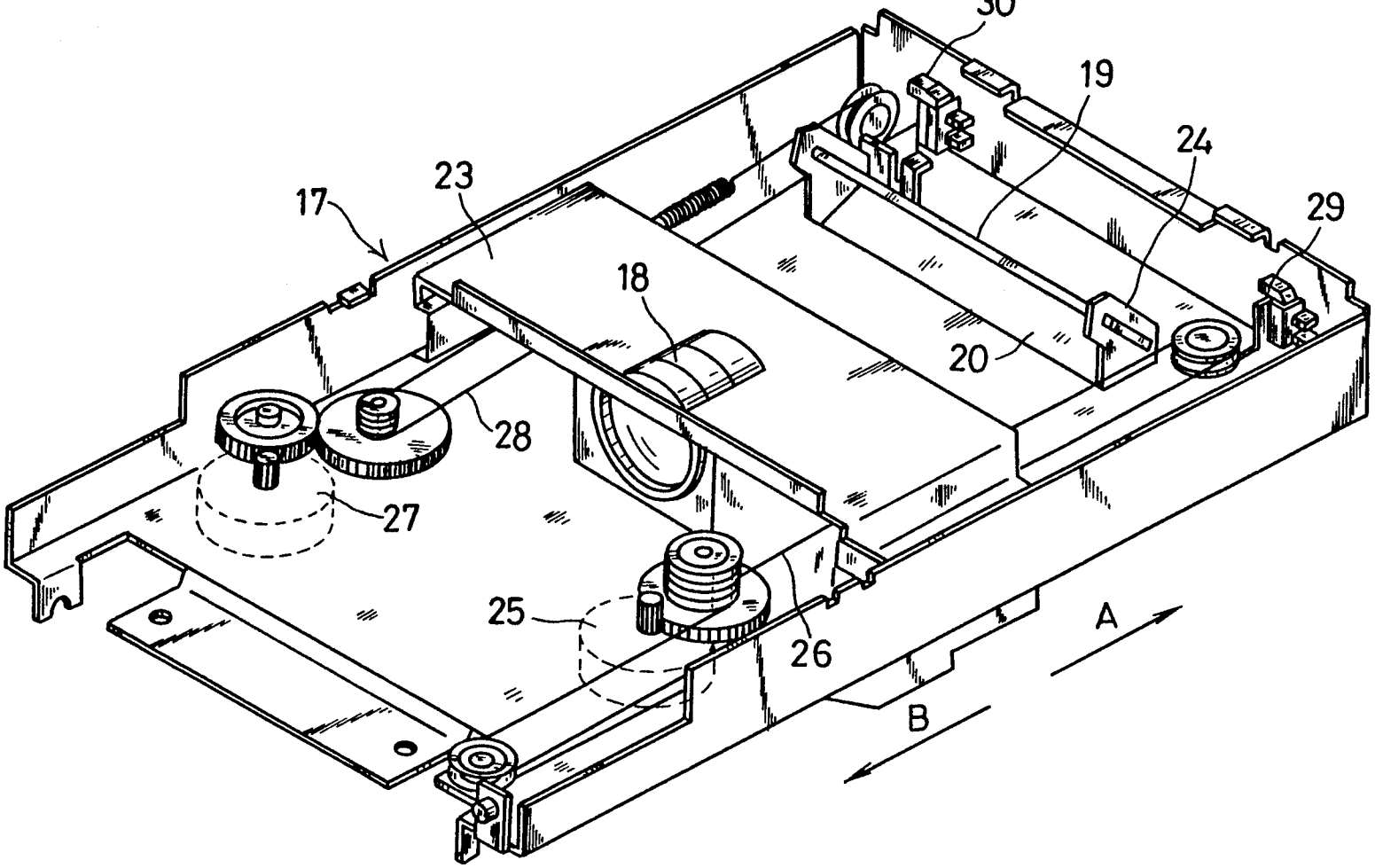

FIG. 1 is a diagram showing a structure of a main portion of an electrophotographic copying machine of an embodiment according to the present invention, and FIGS. 2 and 3 are perspective views showing the main portion of FIG. 1 in detail. Referring to FIGS. 1, 2 and 3, a contact glass plate 1 holds an original sheet thereon, an original mat 2 for covering up or out the contact glass plate 1, an exposure lamp 3 emitting light for scanning the original sheet. Numeral 4 denotes a reflector. Further, a first mirror 5 reflects an image light from the original sheet which the exposure lamp 3 irradiate, a second mirror 6 reflects the image light from the first mirror 5, and a third mirror 7 reflects the image light from the second mirror 6.

A first moving frame 8 carries the exposure lamp 3, the reflector 4 and the first mirror 5, while the second moving frame 9 carries the second and third mirrors 6, 7. The first moving frame 8 and the second moving frame 9 are slidably set on optical rails 10 and 11, respectively. An optical motor 12 is a DC servo motor of which turning effort is transmitted to the first and second moving frames 8 and 9, respectively, through wires 13 and 14, and thereby the first and second moving frames 8 and 9 slide on the optical rails 10, 11 in a direction corresponding to an arrow A or B. A home position switch 15 detects that the first moving frame 8 returns to its home position, and a timing switch 16 is for confirming whether the first moving frame 8 is in the scanning start position. A lens unit 17 has a lens 18, a fourth mirror 19, a fifth mirror 20 and a sixth mirror 21, and the image light reflected by the third mirror 7 traverse the lens 18 and the fourth, fifth and sixth mirrors 19, 20 and 21 to image on a photoconductor drum 22. In the lens unit 17, as shown in FIG. 3, the lens 18 is held by a lens moving frame 23 which slides in the lens unit, while the fourth and fifth mirrors 19, 20 are held by a mirror moving frame 24 which slides in the same. A lens motor 25 is a stepping motor of which turning effort is transmitted to the lens moving frame 23 through wire 26, and thereby the lens moving frame 23 moves in the direction of the arrow A or B. A mirror motor 27 is a stepping motor of which turning effort is transmitted to the mirror moving frame 24 through wire 28, and thereby the mirror moving frame 24 moves in the direction of the arrow A or B. A lens home position switch 29 operates when the lens moving frame 23 moves in the direction of the arrow A to reach its home position, while a mirror home position switch 30 operates when the mirror moving frame 24 moves in the direction of the arrow A to reach its home position.

Figure 4:
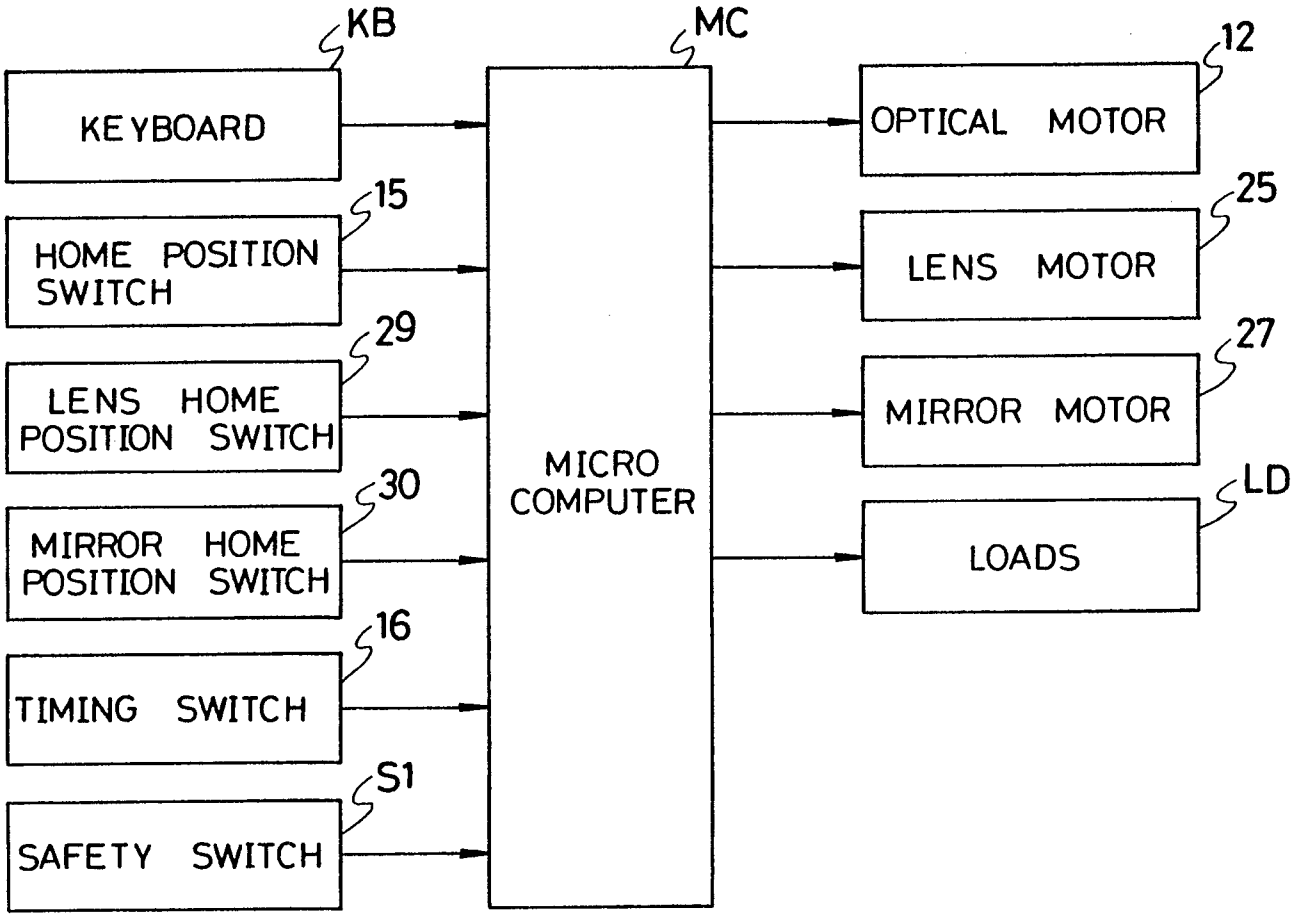
FIG. 4 is a block diagram showing a control unit of the electrophotographic copying machine shown in FIG. 1.

FIG. 4 is a block diagram showing a control unit of the electrophotographic copying machine of FIG. 1, comprising a microcomputer MC composed of a CPU, a ROM, a RAM and an I/O port, a keyboard KB for inputting copying conditions such as a copy magnification, the number of copies and the like and various commands such as a command of starting to copy, a safety switch S1 turning off when a door for maintenance service (not shown) of this machine is opened but turning on when it is closed, and loads LD of various kinds necessary for the copying operation. The microcomputer MC receives input from each of the keyboard KB, the home position switch 15, the lens home position switch 29, the mirror home position switch 30, the timing switch 16 and the safety switch S1 to apply output to each of the optical motor 12, the lens motor 25, the mirror motor 27 and the loads LD.

Figure 5:
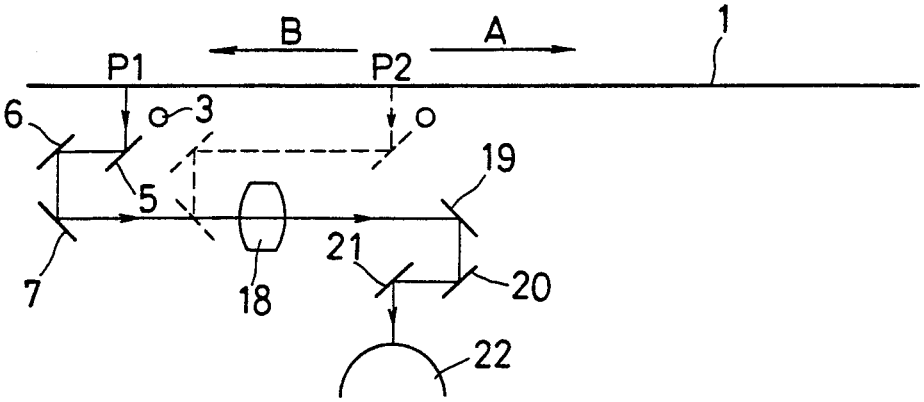
FIGS. 5(*a*) and 5(*b*) are diagrams for explaining a state of setting a magnification in the electrophotographic copying machine shown in FIG. 1.
Figure 5:
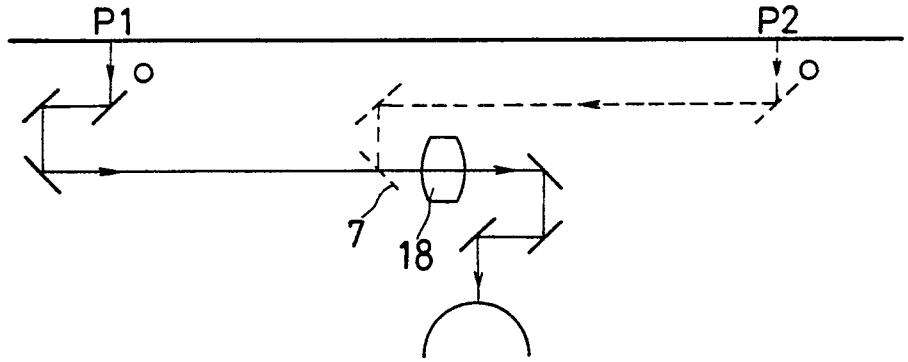
Figure 6:
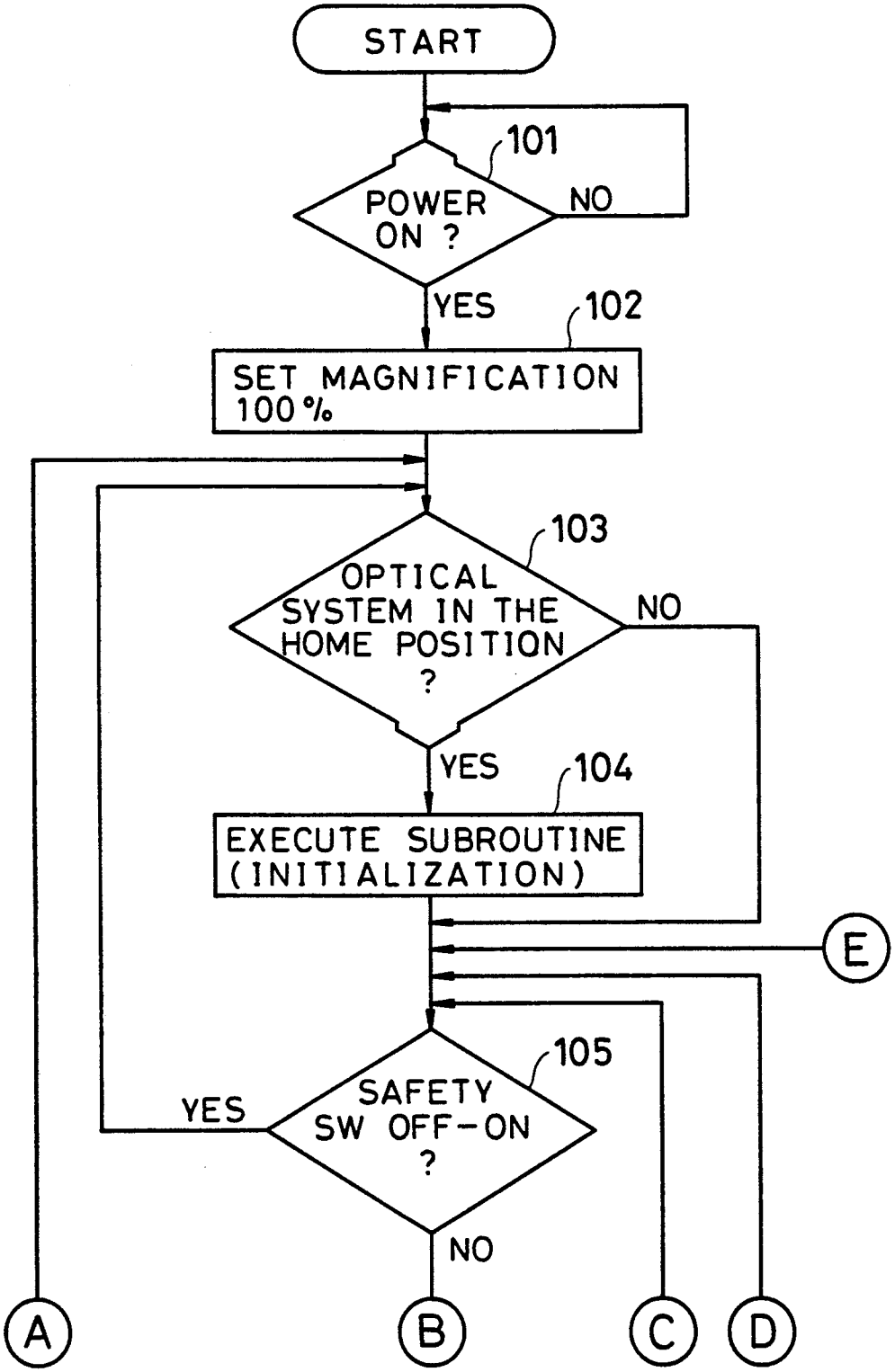
FIGS. 6 through 11 are flow charts for explaining main operations of the embodiment shown in FIG. 1.
Figure 7:
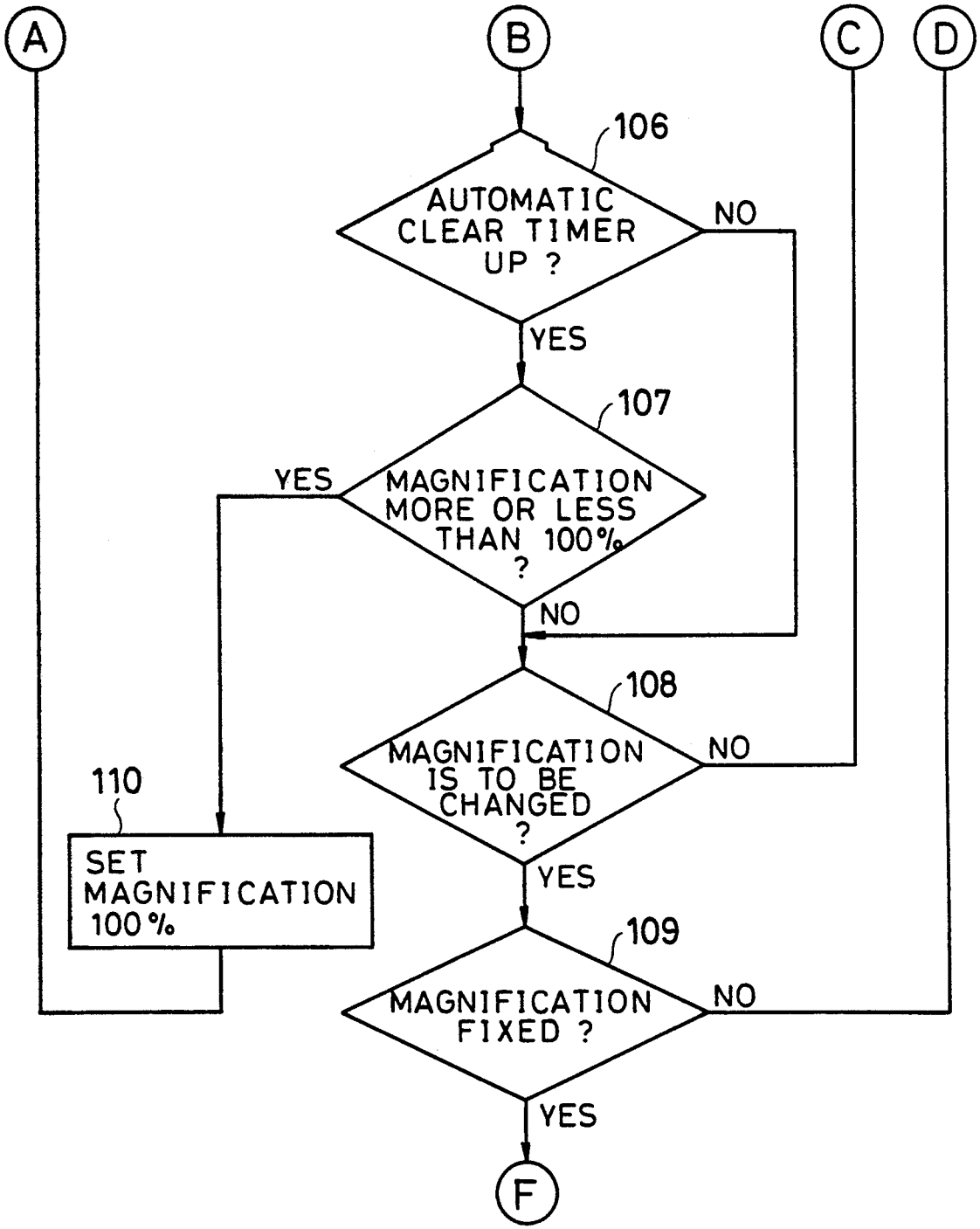
Figure 8:
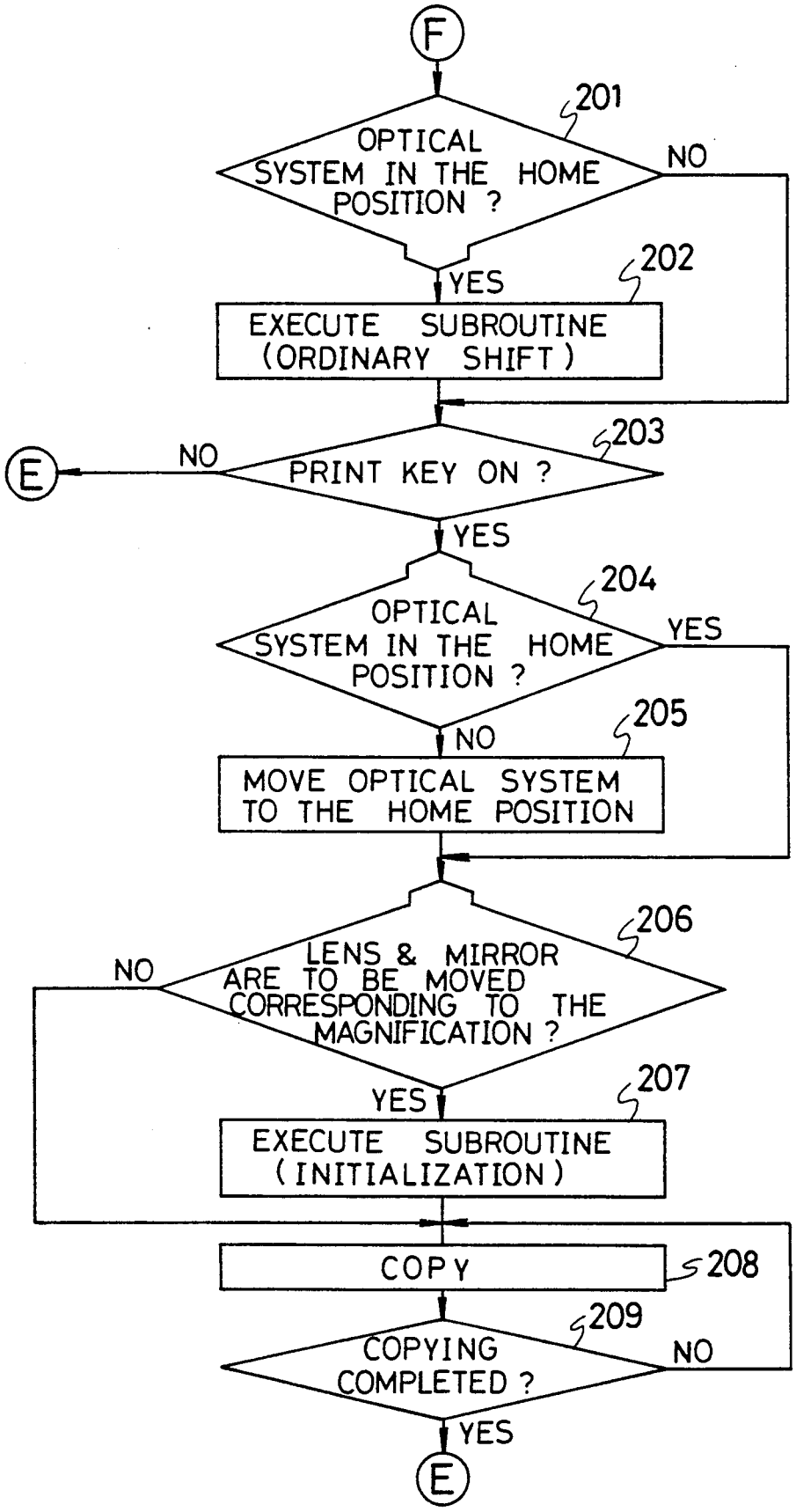

FIGS. 5(*a*) and 5(*b*) are diagrams for explaining the copy magnification setting operation in the electrophotographic copying machine structured as mentioned above; FIG. 5(*a*) shows the relations in position between the optical system and the lens with the copy magnification 100%, while FIG. 5(*b*) shows the relations in position between them with the copy magnification 50%. The original sheet set on the contact glass plate 1 is exposed and scanned by the optical system in the direction of the arrow A in the range from a position P1 to a position P2. Assume, for example, that a paper jam occurs in copying with copy magnification 50% and therefore the optical system stops in the position shown by a broken line in FIG. 5(*b*), and the magnification is changed into a scale of enlargement after the treatment for the paper jam. The optical system moves in the direction of the arrow B towards its home position, while the lens 18 moves towards the position corresponding to the scale of enlargement, or the position shown in FIG. 5(*a*). However, when the optical system moves slowly, the lens 18 should collide with the third mirror 7 in the optical system. Thus, in this embodiment, when the optical system is reset after the treatment for the paper jam is completed, it is arranged that the optical system should necessarily return to the home position before the lens 18 moves.

With reference to flow charts in FIGS. 6 through 11, the operations of the electrophotographic copying machine will be explained in more detail. First, when the electrophotographic copying machine is turned on at Step 101, the magnification is set at 100% (Step 102), and after it is confirmed whether the optical system is in its home position (Step 103), the subroutine (initialization) mentioned below is executed (Step 104). When the safety switch S1 does not turn off (Step 105), after a timer for clearing, after a specified period of time, various conditions inputted from the keyboard KB, or the automatic clear timer, counts up (Step 106), it is confirmed whether the magnification is 100% (Step 107). If the magnification is 100%, another magnification is newly inputted (Step 108), and after the newly inputted magnification is fixed (Step 109), it is confirmed whether the optical system is in the home position (Step 201), and the subroutine (ordinary shift) mentioned below is executed (Step 202). Then, when a command to start copying is inputted from the keyboard KB (Step 203), it is confirmed whether the optical system is in the home position (Step 204). If not, the optical system moves to the home position (Step 205). Then, it is confirmed whether the lens 18 and mirrors 19, 20 have to be moved according to the magnification already set (Step 206). If not, the copying operation is executed (Step 208), and after copying by a specified number (Step 209), the routine returns to Step 105. When the copy magnification is not 100% at Step 107, the magnification is set at 100% (Step 110), and the routine returns to Step 103. When the command to copy is not inputted at Step 203, the routine returns to Step 105.

Figure 9:
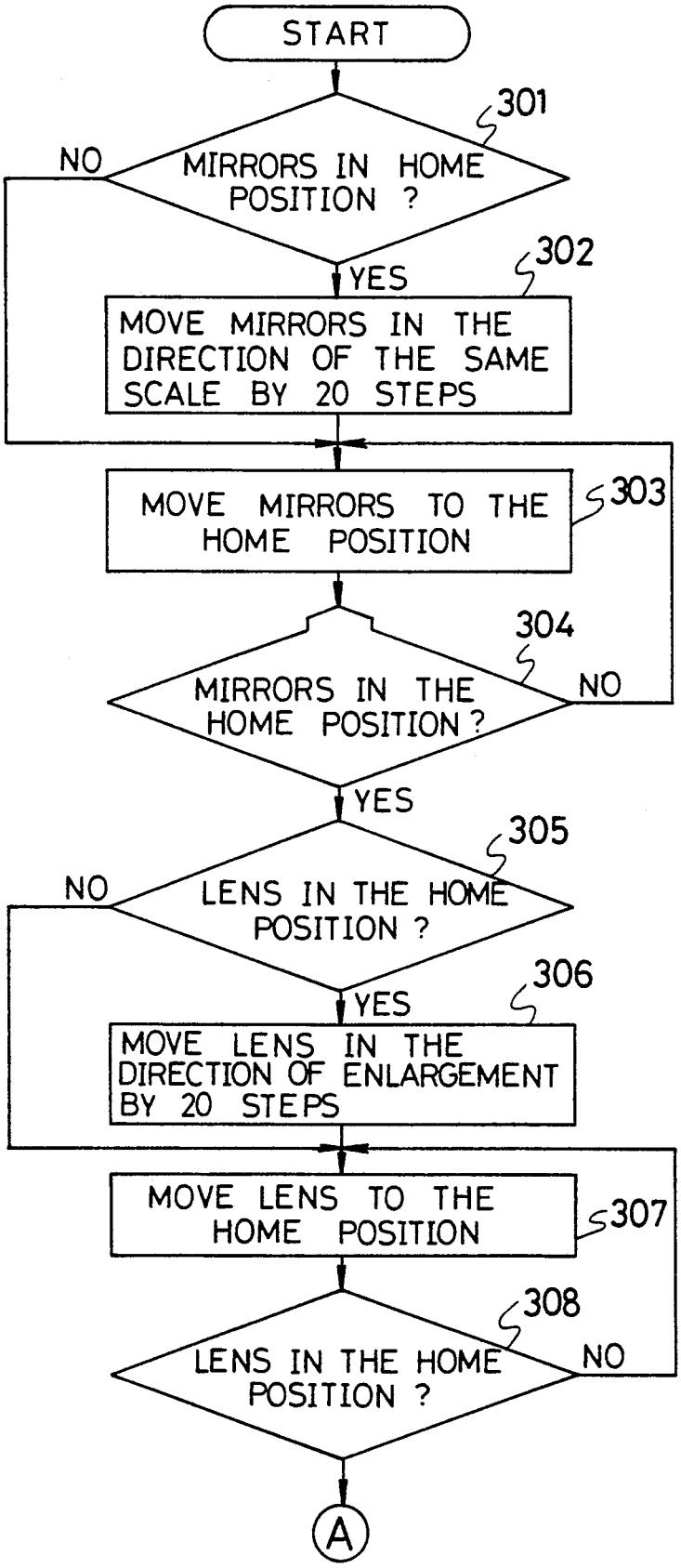
Figure 10:
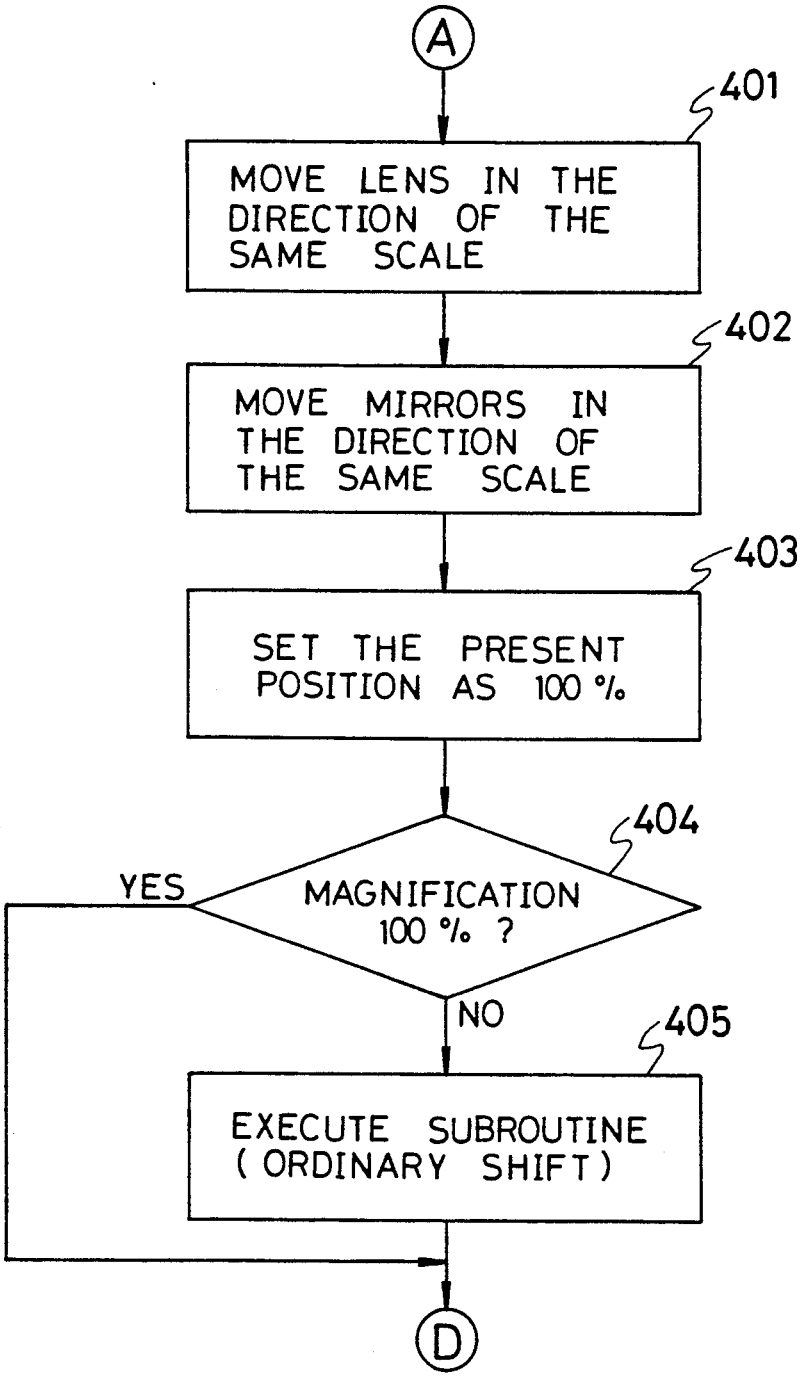

The subroutine (initialization) will be explained in conjunction with the flow charts in FIGS. 9 and 10.

At Step 301 it is confirmed whether the mirrors 19, 20 are in their respective home positions. If so, the mirrors 19, 20 are moved by the mirror motor 27 in the direction corresponding to the equivalent scale (i.e., the direction of the arrow B) by 20 steps (Step 302). When the mirrors 19, 20 move towards the home positions (Step 303) and reach the home positions (Step 304), it is confirmed whether the lens 18 is in its home position (Step 305). If so, the lens 18 is moved by the lens motor 25 in the direction corresponding to the scale of enlargement (the direction of the arrow B) by 20 steps (Step 306). The lens 18 is moved toward the home position again (Step 307), and when it reaches the home position (Step 308), the lens 18 is moved to the position corresponding to the equivalent scale (magnification 100%) (Step 401). Also the mirrors 19, 20 are moved to the positions of the equivalent scale (Step 402). When the lens 18 and mirrors 19, 20 reach their respective desired positions, those positions are set (stored) as positions corresponding to the magnification 100% (Step 403). When the magnification already set is not 100% (Step 404), the subroutine (ordinary shift) is executed (Step 405).

Figure 11:
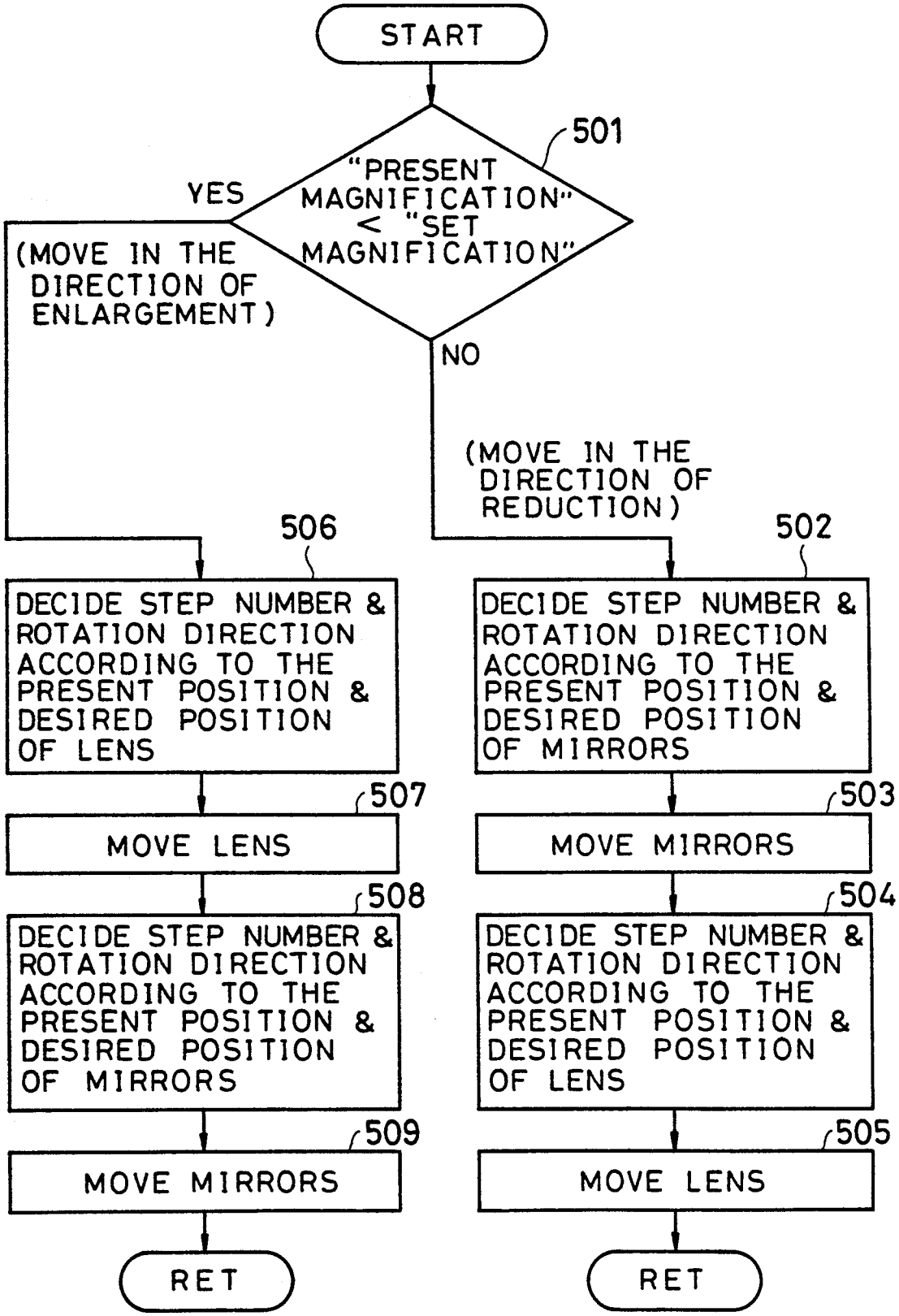

Then, the subroutine (ordinary operation) will be explained in conjunction with the flow chart in FIG. 11. First, the present magnification and the magnification already set are compared at Step 501. If the magnification already set is smaller than the present magnification, the rotation step number and rotation direction of the mirror motor 27 are determined according to the present positions of the mirrors 19, 20 and their respective desired positions (Step 502), and the mirrors 19, 20 move (Step 503). At that time, the rotation step number and rotation direction of the lens motor 25 are determined according to the present position and desired position of the lens 18 (Step 504), and accordingly, the lens 18 moves (Step 505). When the magnification already set is larger than the present magnification at Step 501, the step number and rotation direction of the lens motor 25 are determined according to the present position and desired position of the lens 18 (Step 506), and accordingly, the lens 18 moves (Step 507). Then, the step number and rotation direction of the mirror motor 27 are determined according to the present positions and desired positions of the mirrors 19, 20 (Step 508), and accordingly, the mirrors 19, 20 move (Step 509).

In this way, when the copying operation is once stopped because of a paper jam or the like and thereafter it can be resumed, the optical system and the lens can return (can be reset) at their respective home positions and the positions of the equivalent scale without any trouble.

Now, another copy magnification setting operation in this embodiment will be described.

Figure 12:
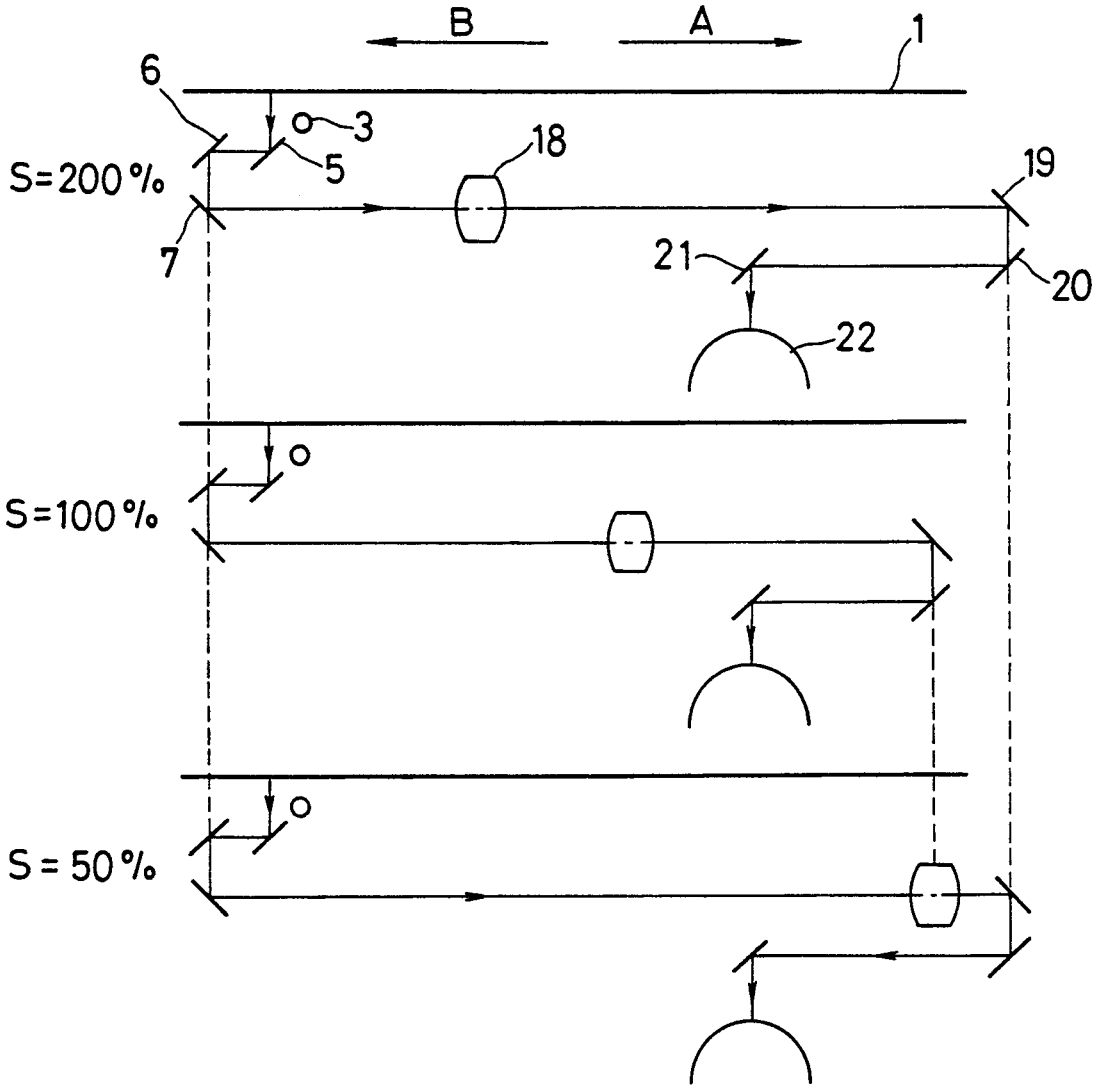
FIG. 12 is a diagram for explaining a state of setting another magnification in the electrophotographic copying machine.

FIG. 12 is a diagram for explaining the relations in position between the lens 18 and the fourth and fifth mirrors 19, 20 when the copy magnification S is set at 200%, 100% and 50%, respectively. As can be seen, the lens 18 travels farther in the direction of the arrow A as the copy magnification S is smaller, while it travels farther in the direction of the arrow B as the magnification S is larger. The fourth and fifth mirrors 19, 20 are set in the farthest positions with regard to the direction of the arrow B when the copy magnification S equals 100%. When the copy magnification S is set more or less than 100%, either way they move in the direction of the arrow A. For example, when the lens 18 and the fourth and fifth mirrors 19, 20 under the condition of the copy magnification S of 50% are moved to the positions corresponding to the magnification S of 100%, a delay to the lens 18 causes the collision of the fourth and fifth mirrors 19, 20 with the lens 18. When the lens 18 and the fourth and fifth mirrors 19, 20 under the condition of the copy magnification s of 100% are moved to the positions corresponding to the magnification S of 50%, a delay to the fourth and fifth mirrors 19, 20 causes the collision of the lens 18 with the fourth and fifth mirrors 19, 20. Thus, the collision of the lens 18 with the fourth and fifth mirrors 19, 20 can be avoided by moving the lens 18 first in the direction of the arrow B and then the fourth and fifth mirrors 19, 20 when a larger copy magnification is required. The collision of the lens 18 with the fourth and fifth mirrors 19, 20 can be also avoided by moving the fourth and fifth mirrors 19, 20 first and then the lens 18 when a smaller copy magnification is required.

The copy magnification setting operation will now be described in detail in conjunction with the flow charts shown in FIGS. 13 through 26. "Automatic clear time" in the following description is a timer for automatically clearing in a predetermined period of time the conditions inputted by the keyboard KB, "lens" means the lens 18, "mirror" means the fourth and fifth mirrors 19, 20, and "the step number" means the displacement or position corresponding to the rotation step number of the lens motor 25 or the mirror motor 27. Table 1 below shows an example of the relations among the step number L of the lens motor 25 from the home position (HP), the step number M of the mirror motor 27 from the same and the magnification S.

TABLE 1

| S | L | M | S | L | M |
|---|---|---|---|---|---|
| H.P | 0 | 0 | 1.30 | 852 | 688 |
| 0.50 | 66 | 142 | 1.40 | 887 | 631 |
| 0.60 | 279 | 438 | 1.50 | 917 | 564 |
| 0.70 | 431 | 613 | 1.60 | 944 | 491 |
| 0.80 | 545 | 712 | 1.70 | 967 | 410 |
| 0.90 | 633 | 761 | 1.80 | 988 | 325 |
| 1.00 | 704 | 776 | 1.90 | 1007 | 236 |
| 1.10 | 762 | 764 | 2.00 | 1024 | 142 |
| 1.20 | 811 | 733 | | | |

Figure 13:
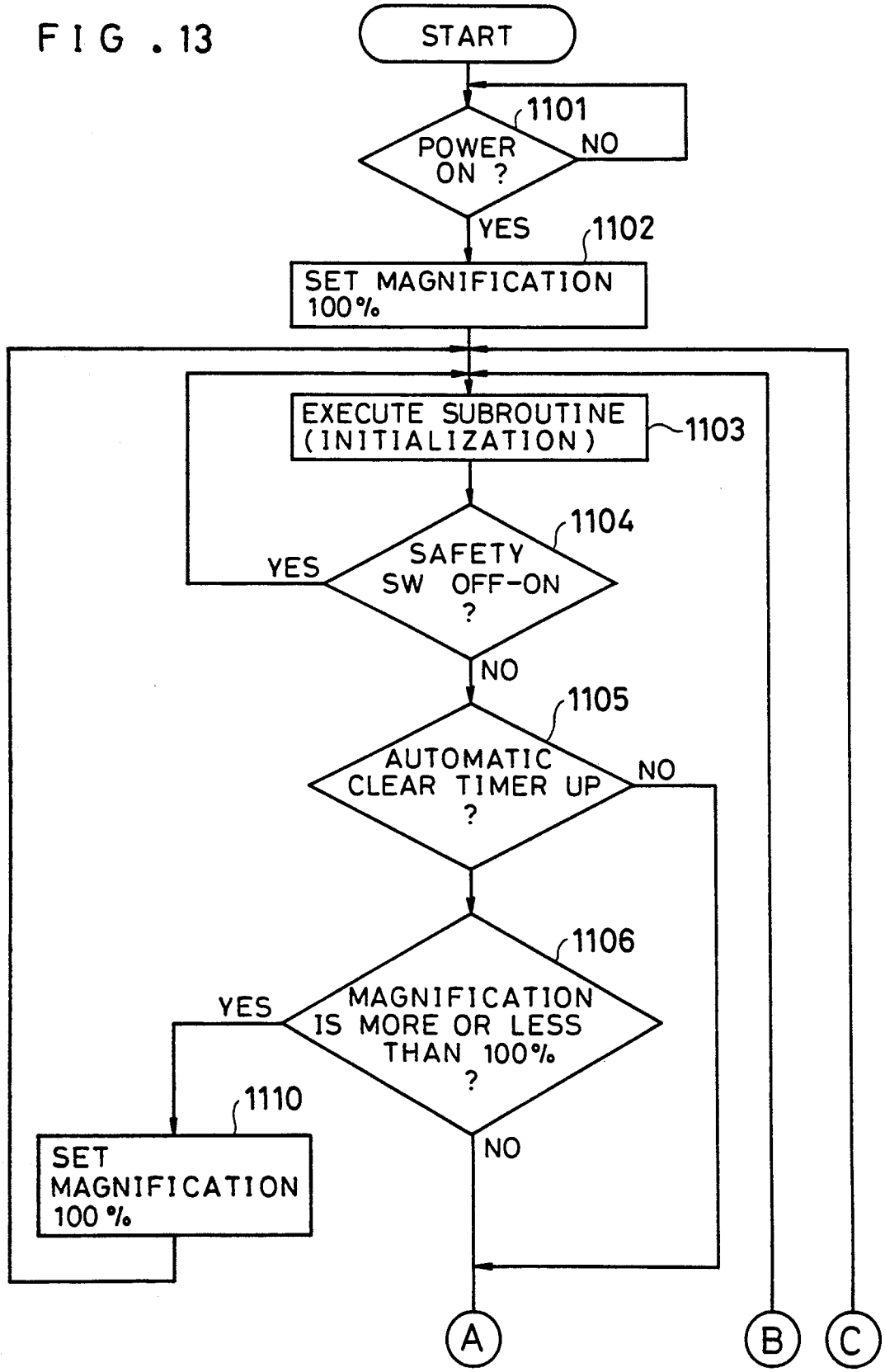
FIGS. 13 through 26 are flow charts for explaining methods of setting a magnification in the electrophotographic copying machine.
Figure 14:
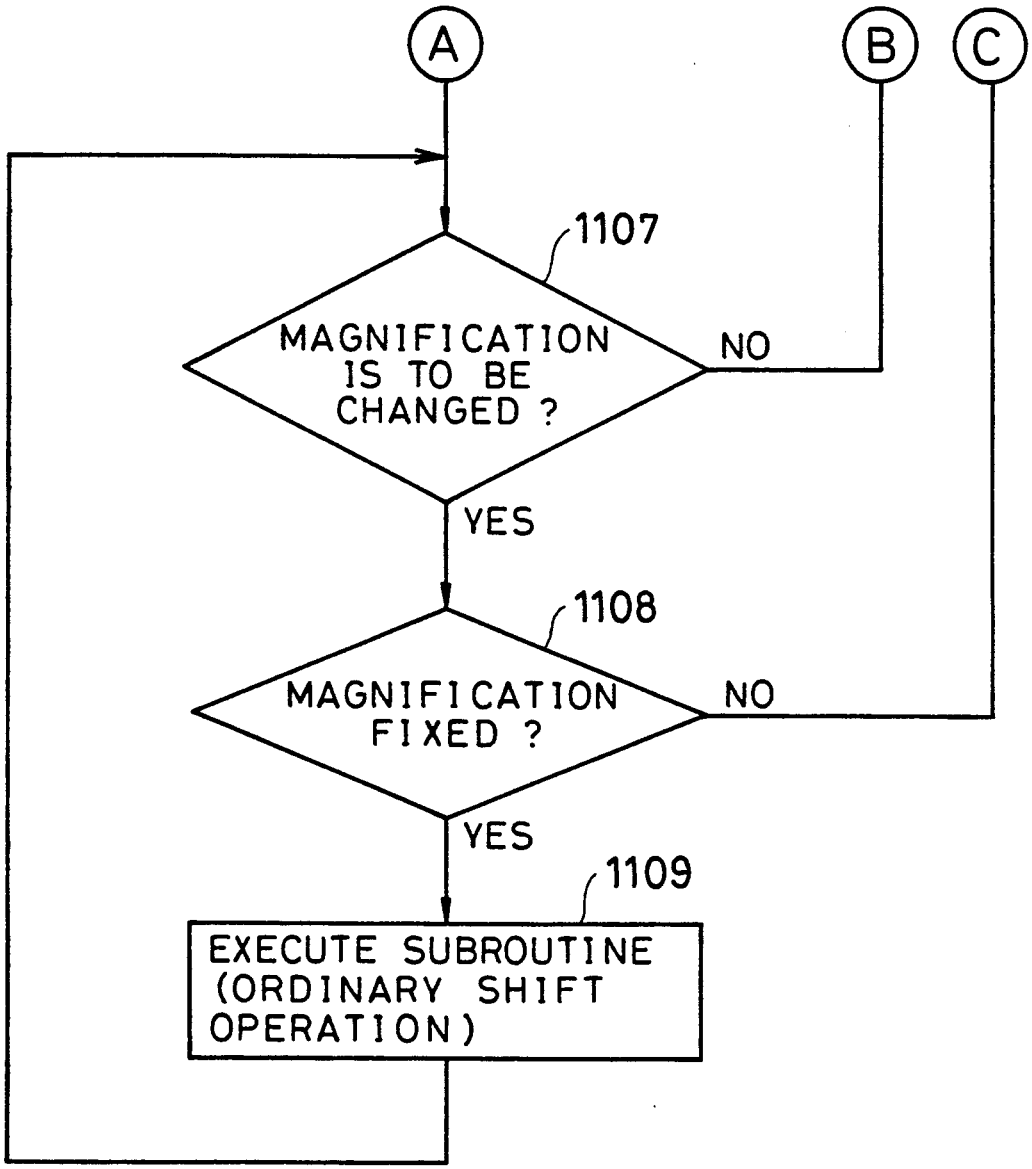
Figure 15:
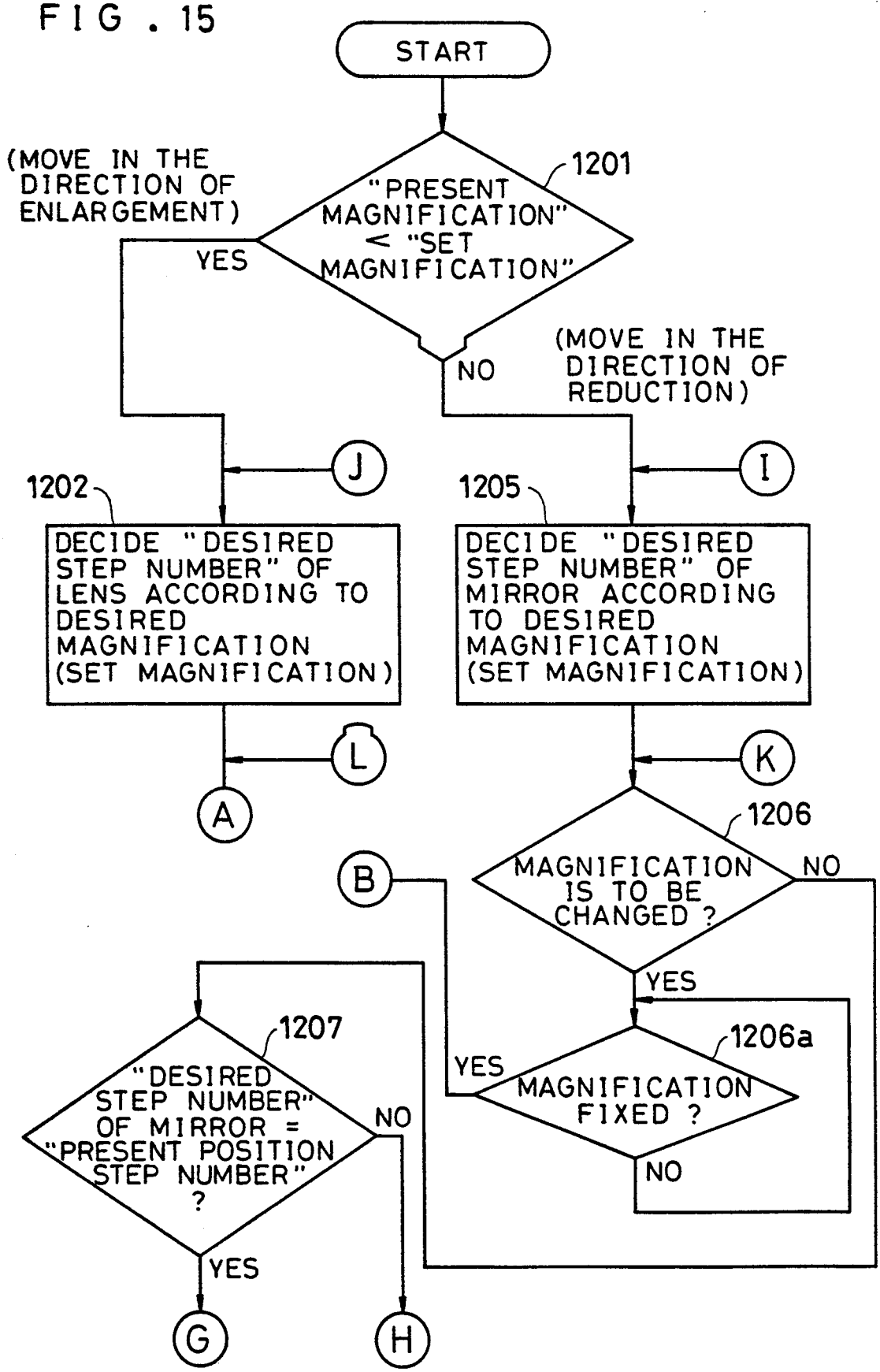
Figure 16:
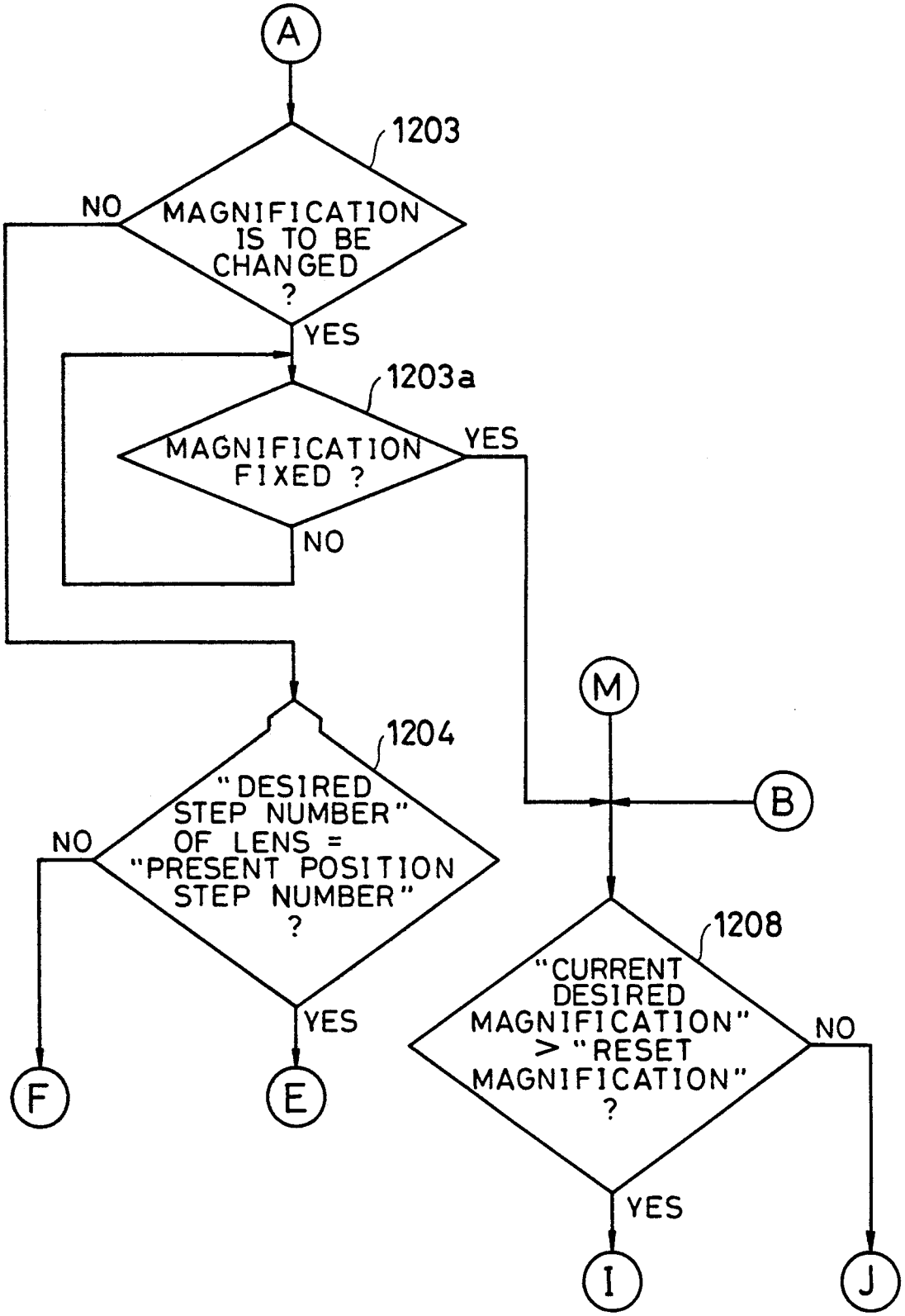
Figure 17:
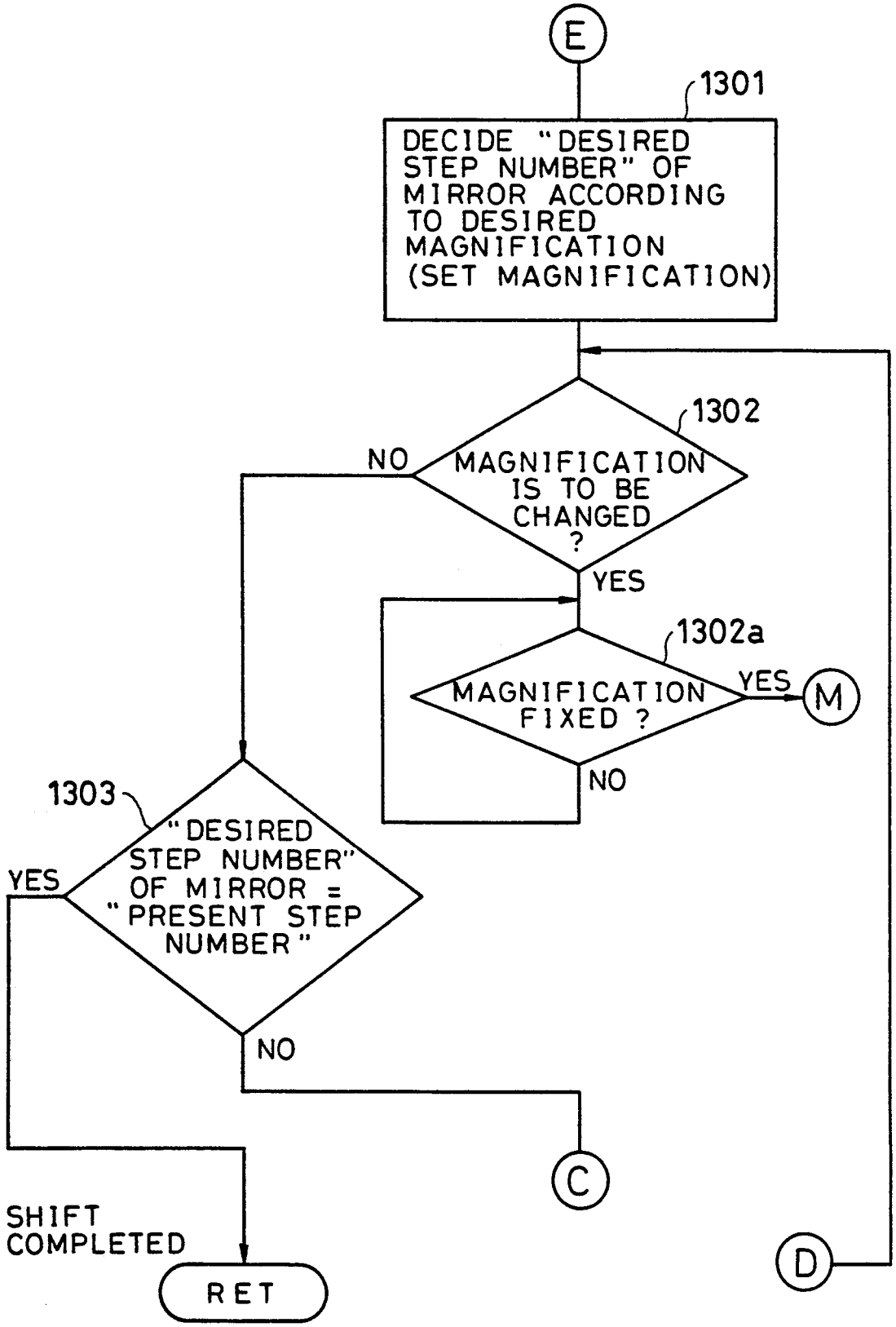
Figure 18:
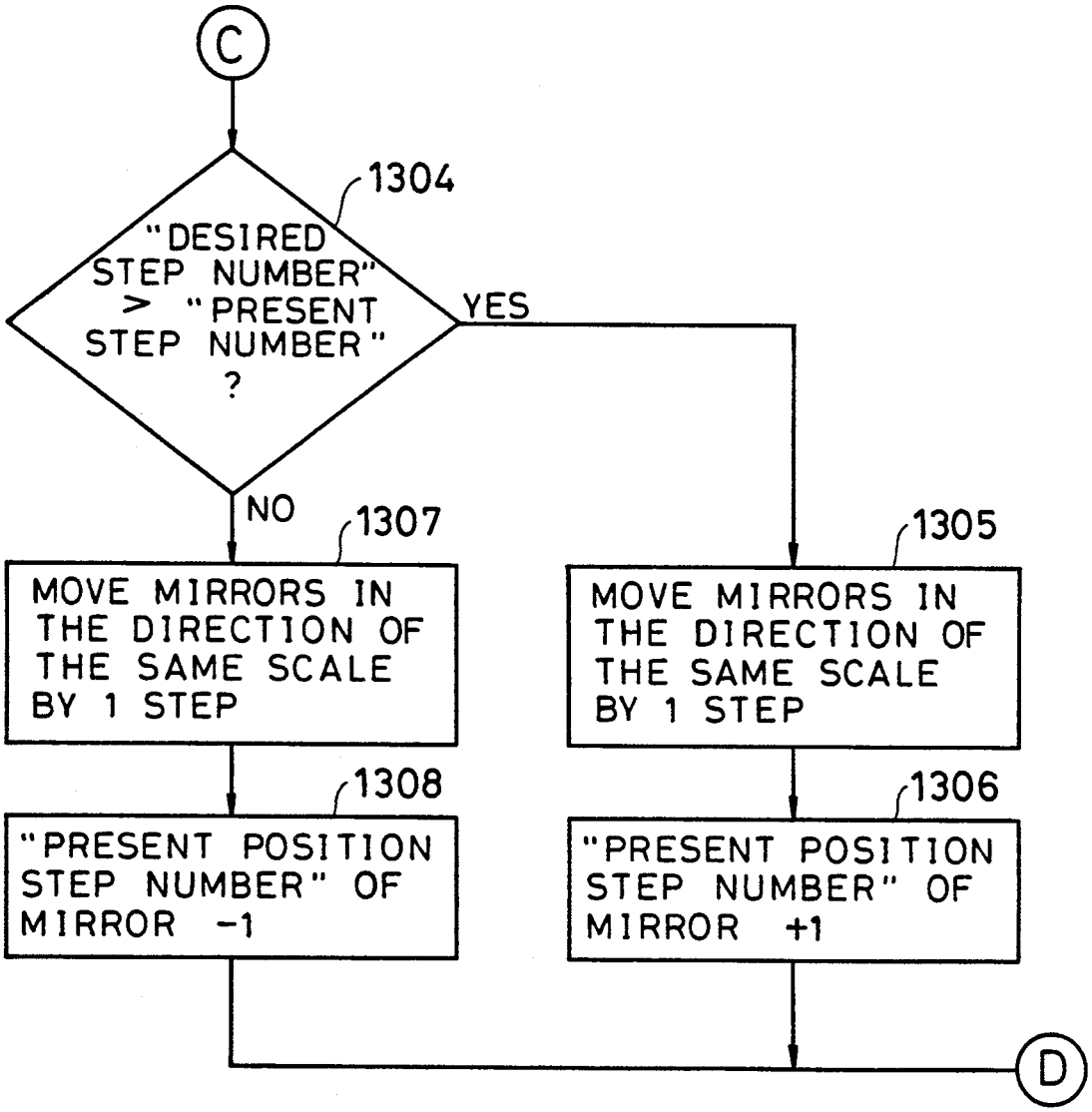
Figure 19:
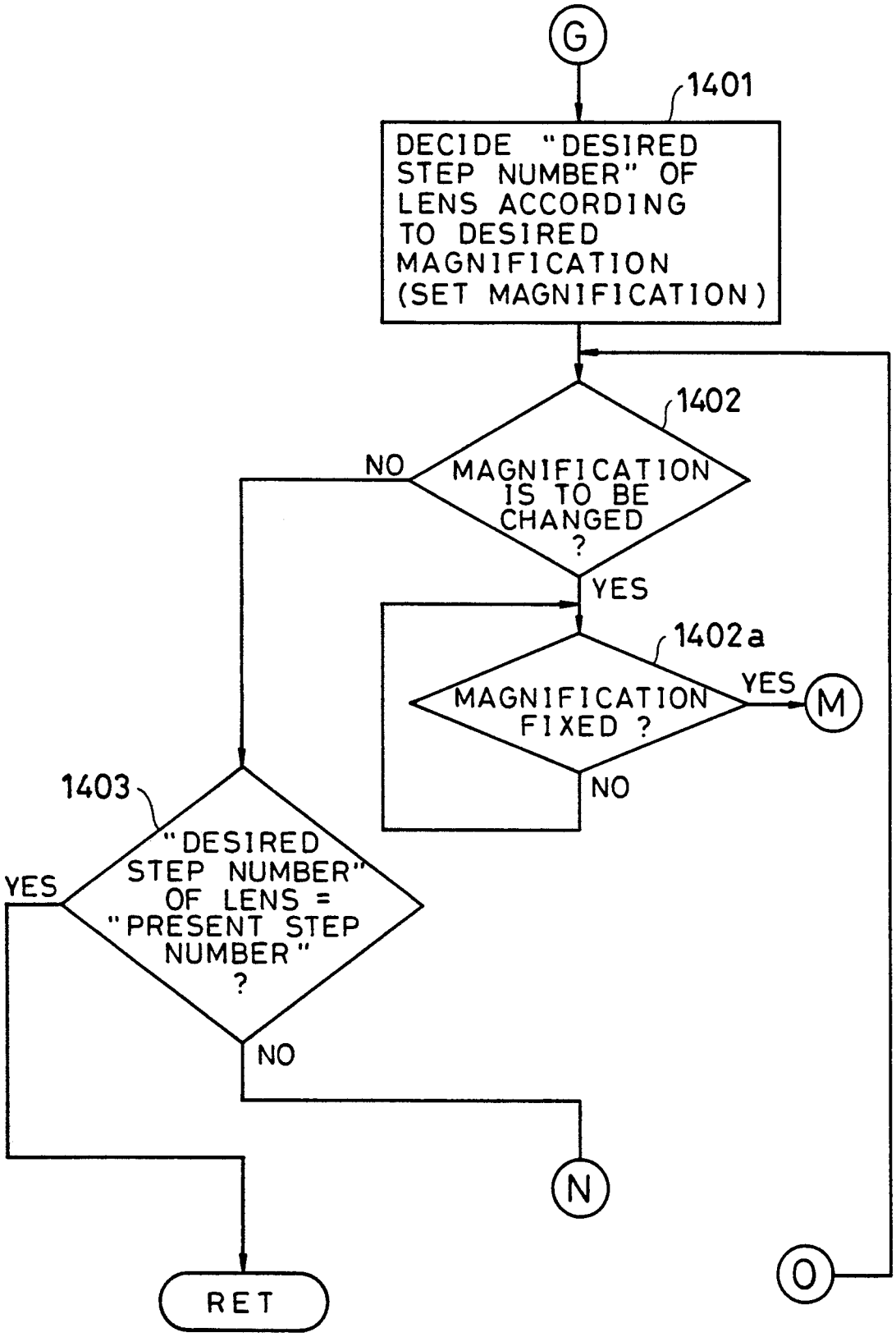
Figure 20:
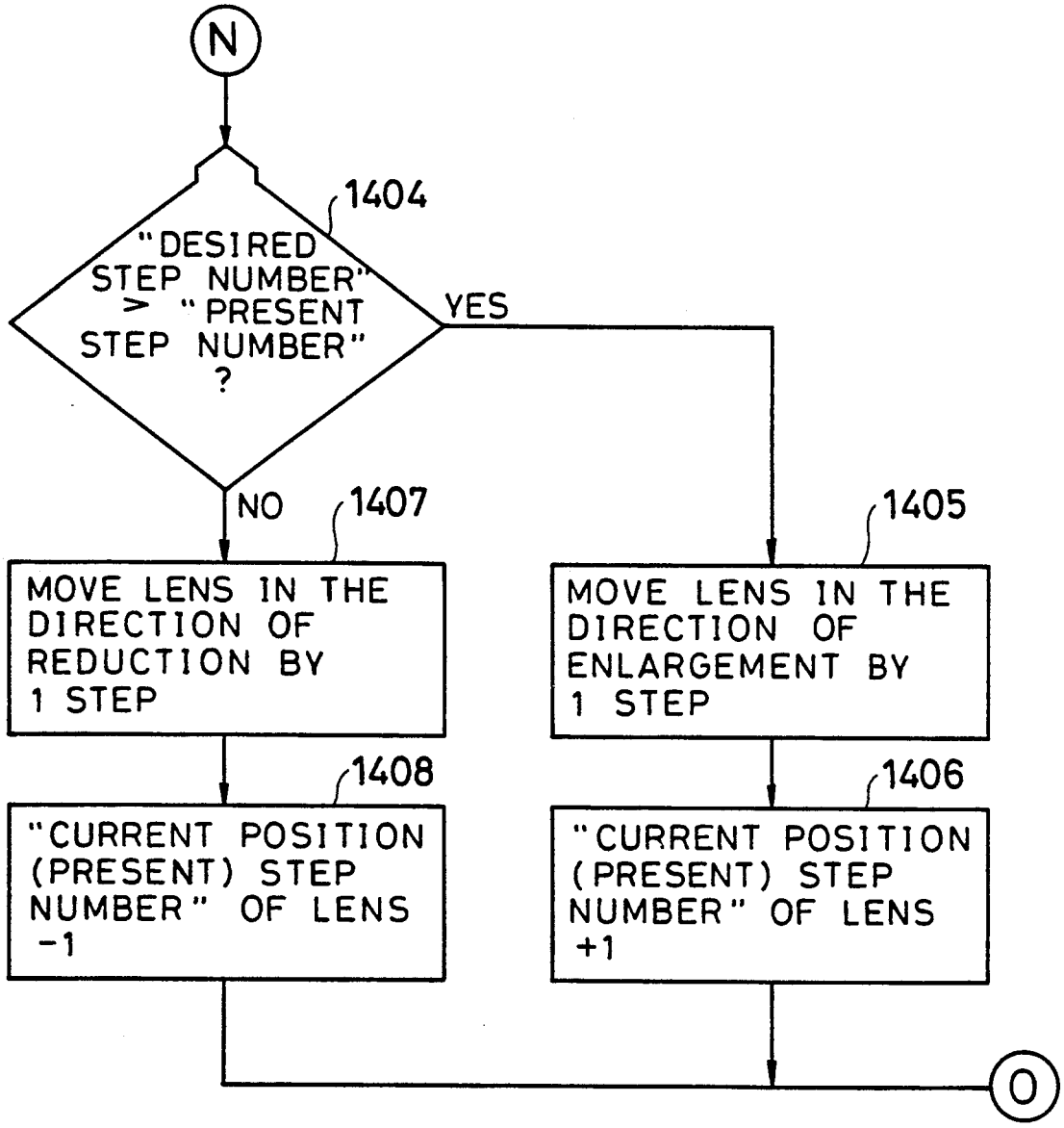
Figure 21:
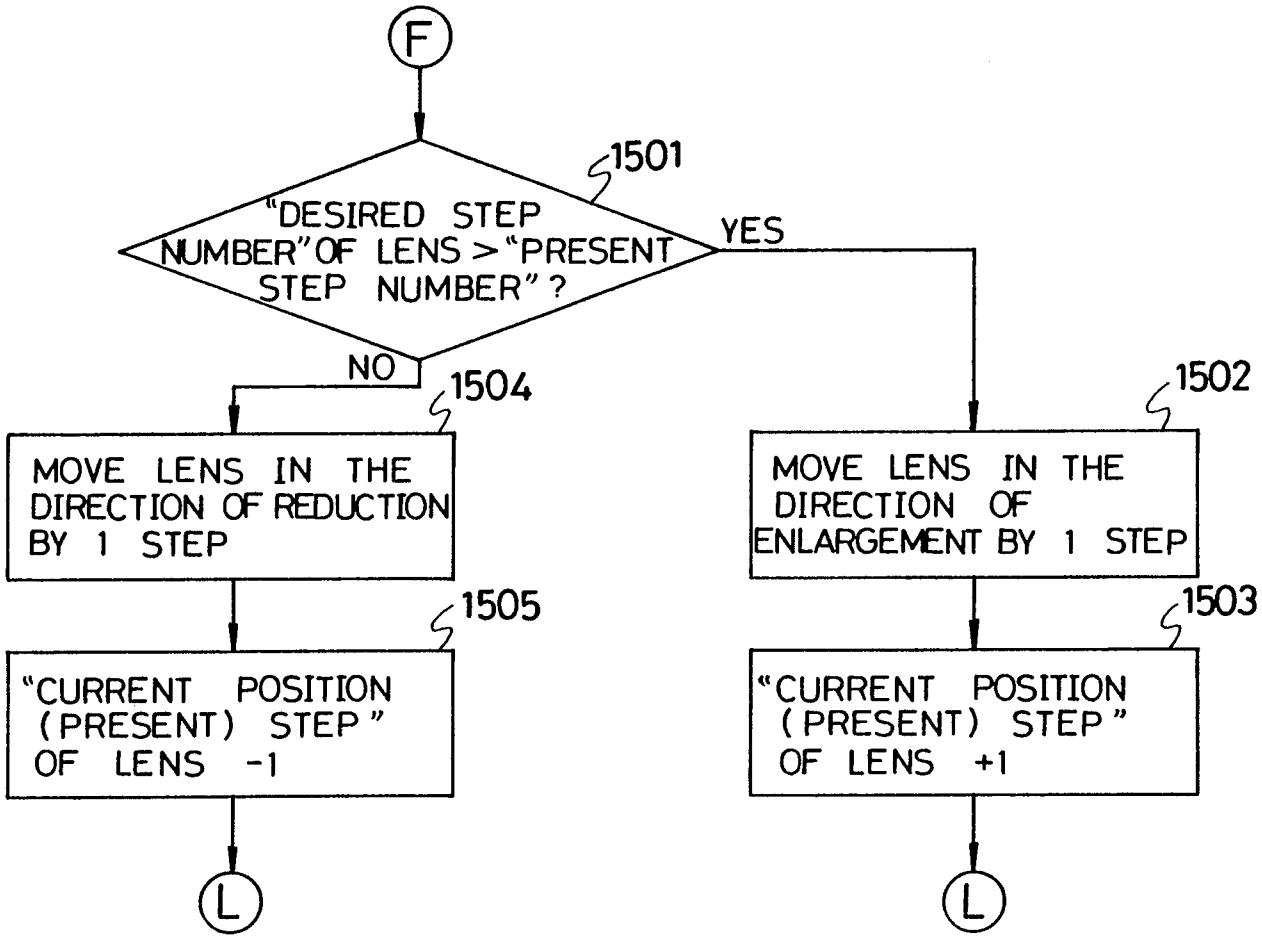
Figure 22:
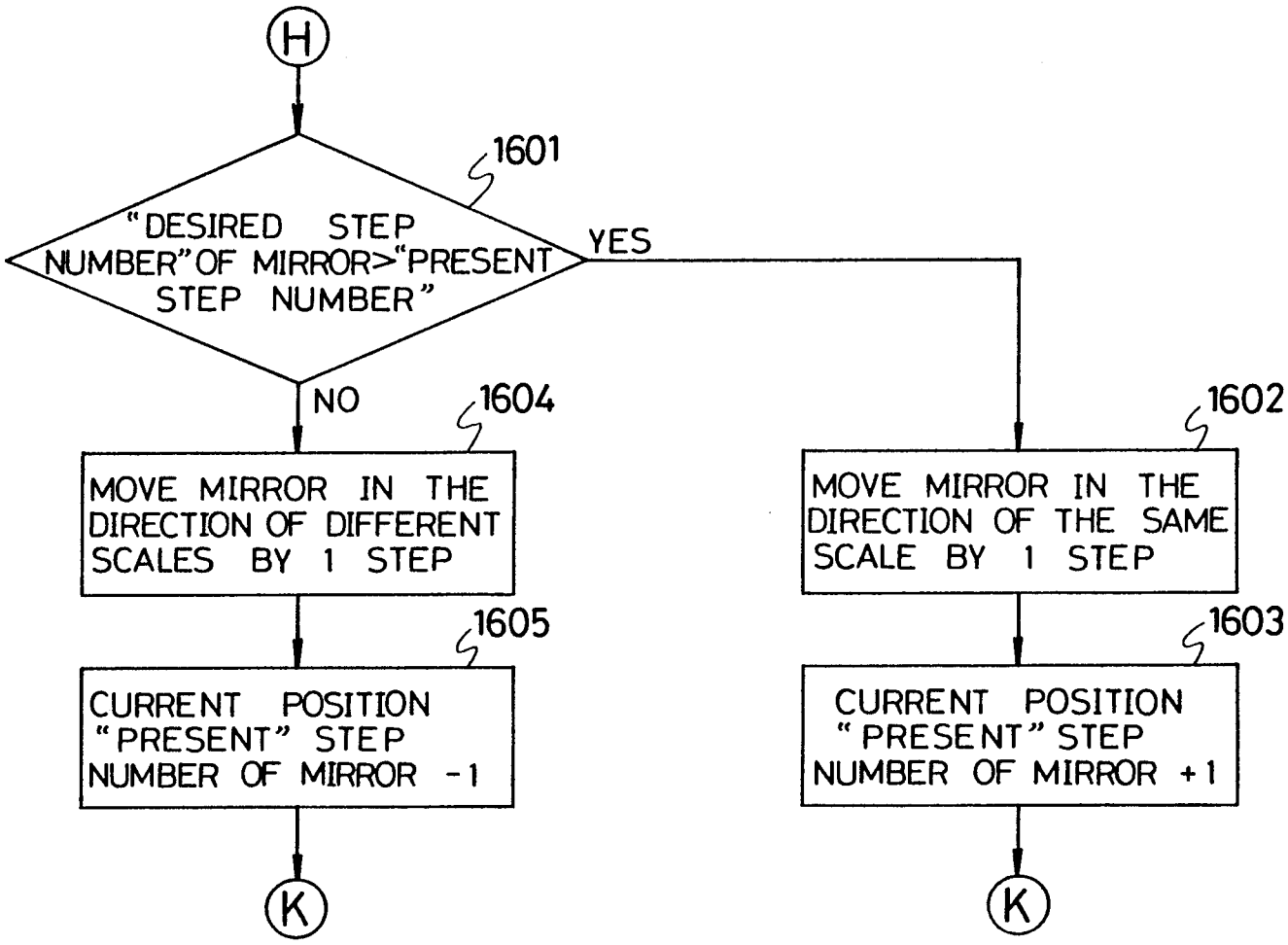
Figure 23:
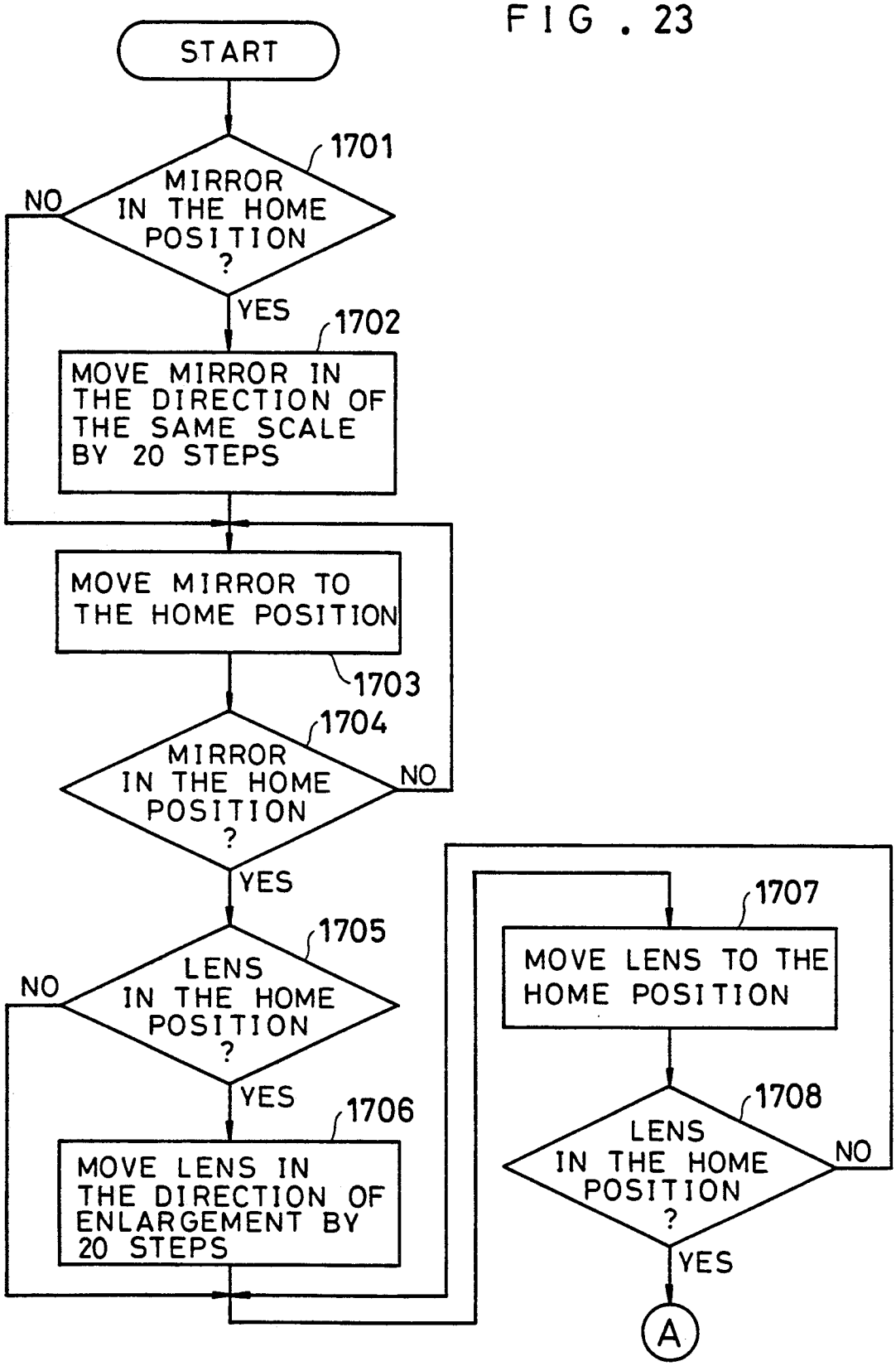
Figure 24:
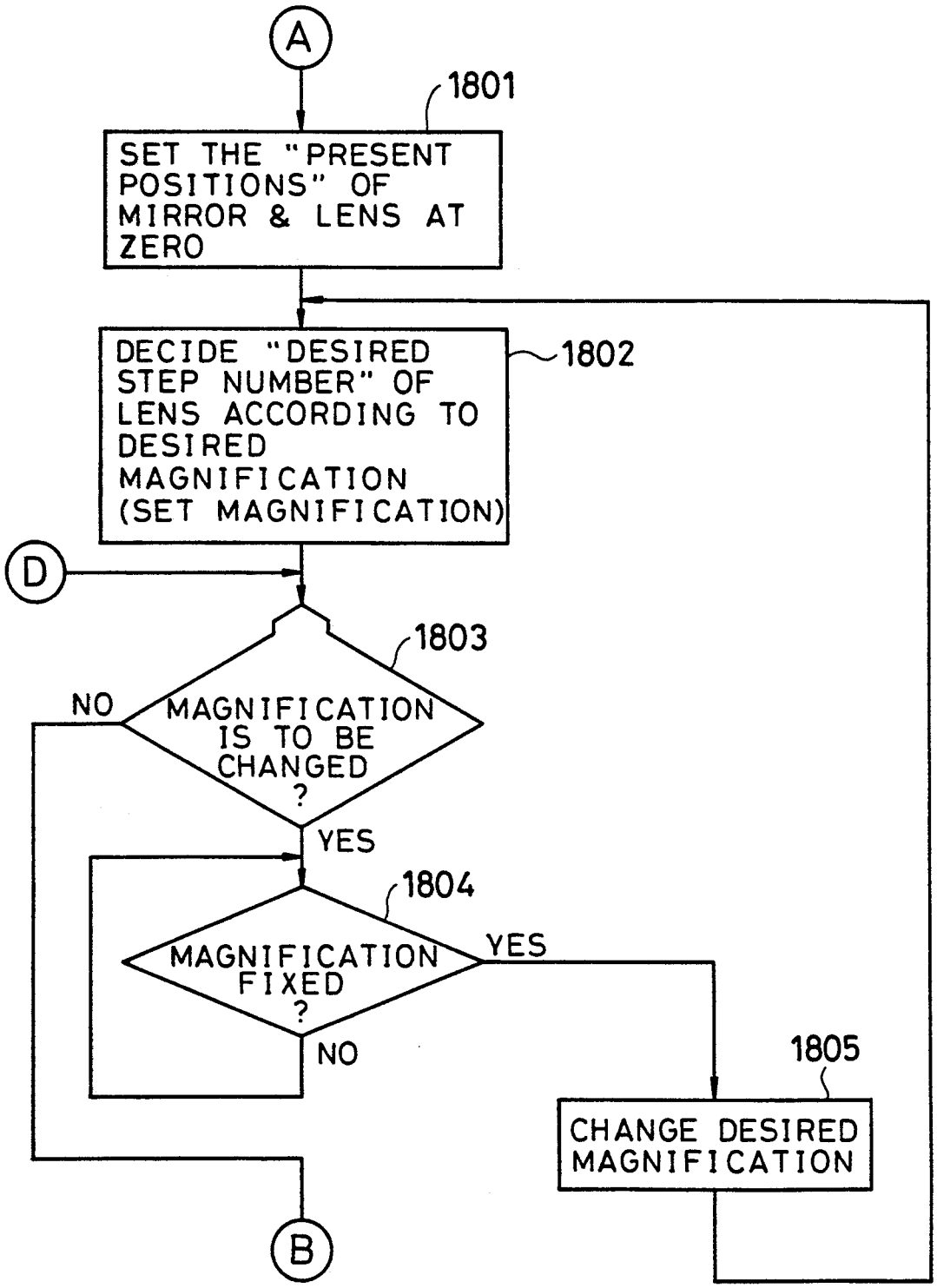
Figure 25:
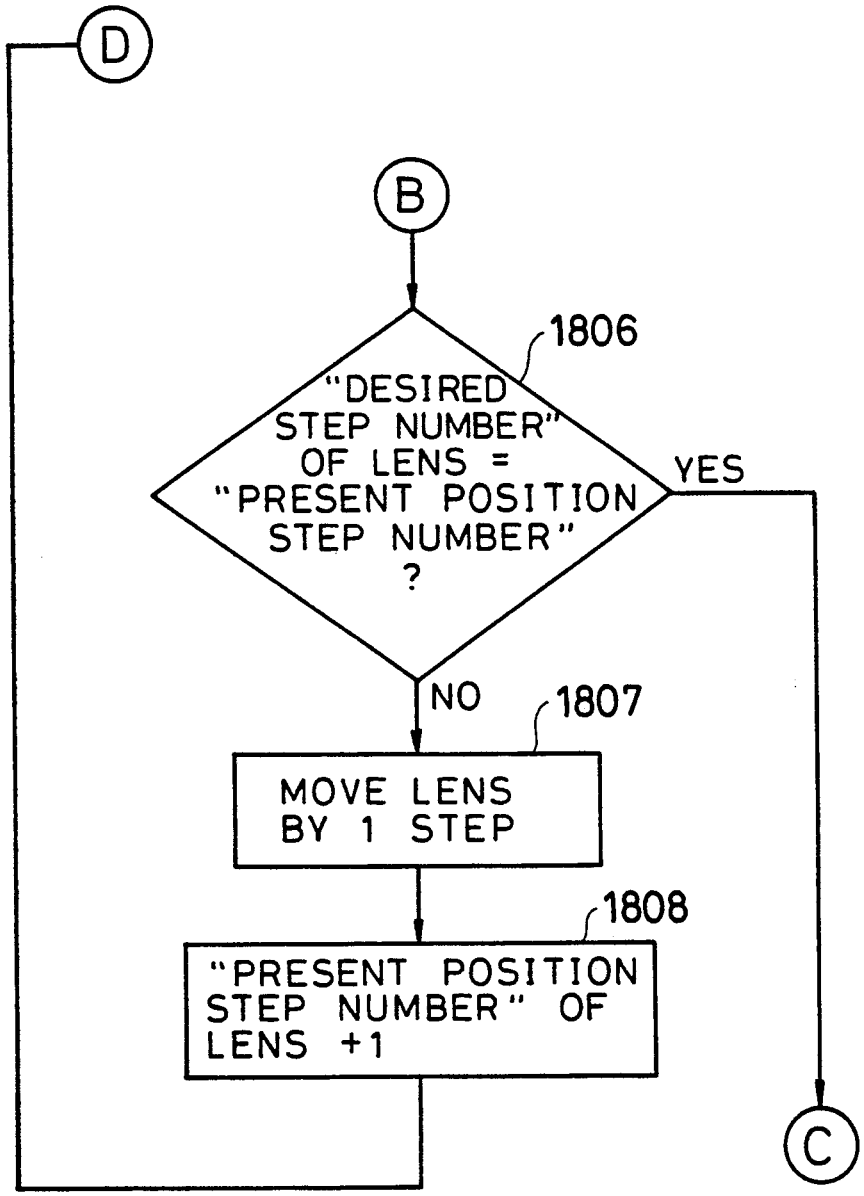
Figure 26:
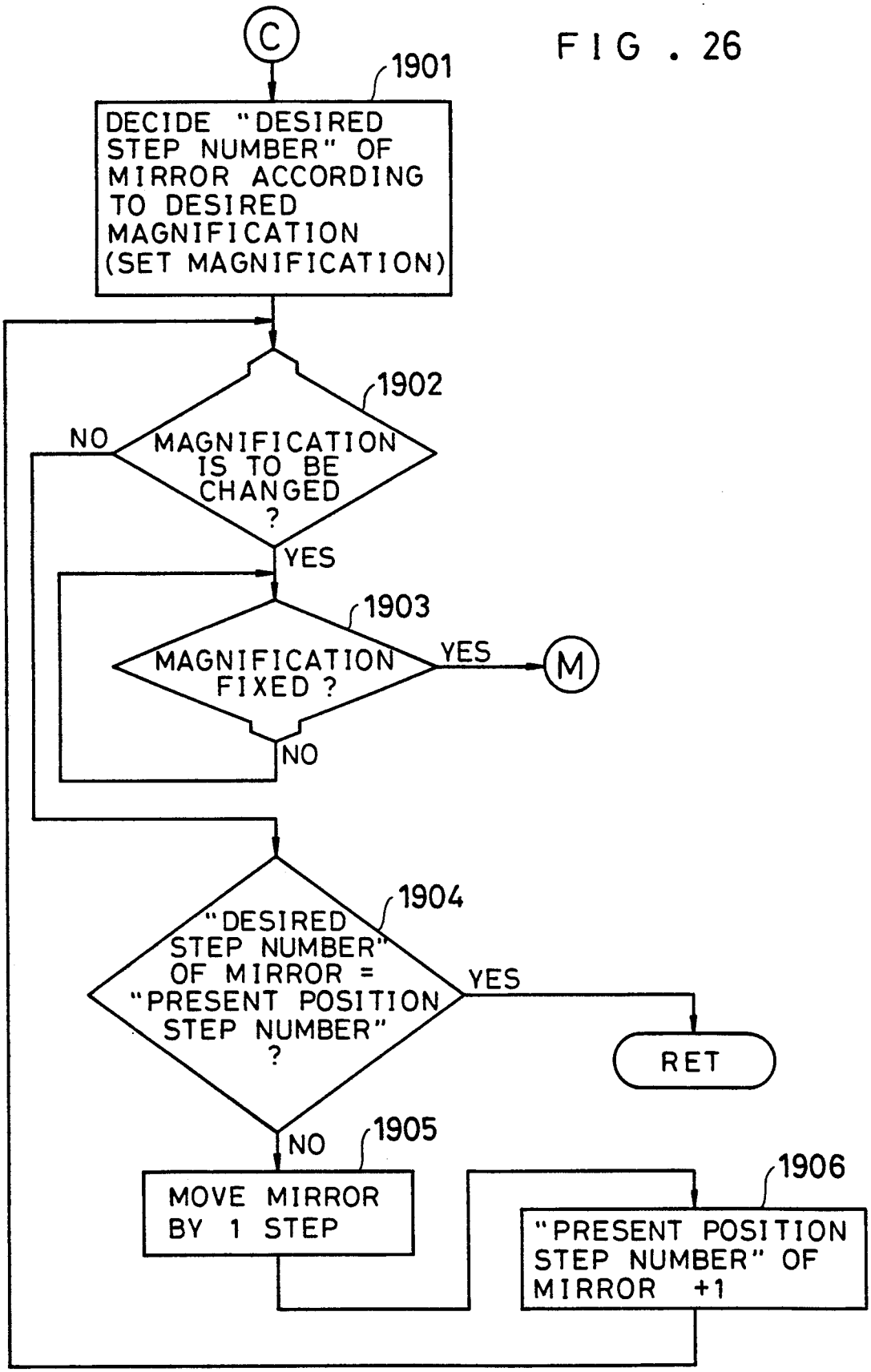

Referring to FIGS. 13 and 14, when the electrophotographic copying machine is turned on (Step 1101), the copy magnification is automatically set at 100% (Step 1102), and the subroutine (initialization) mentioned later is executed (Step 1103). Then, it is confirmed whether a safety switch S1 turns on, that is, a door for maintenance service in the electrophotographic copying machine was once closed (Step 1104). If not, after the automatic clear timer finish a counting (Step 1105), it is confirmed whether the copy magnification is 100% (Step 1106). If more or less than 100%, the magnification is set at 100% (Step 1110), and the routine returns to Step 1103. If the copy magnification is 100% at Step 1106, when the copy magnification is to be changed (Step 1107), it is confirmed whether the magnification is fixed (Step 1108). If so, the subroutine (ordinary shift) mentioned later is executed (Step 1109), and the routine returns to Step 1107.

If the safety switch S1 turns on at Step 1104, when the copy magnification is not to be changed at Step 1107 or when the magnification is not fixed at Step 1108, either way the routine returns to Step 1103. Then, the subroutine (ordinary shift) will be described in conjunction with the flow charts shown in FIGS. 15 through 22. When the newly inputted magnification is larger than the present magnification at Step 1201, the desired step number of the lens motor (stepping motor) moving the lens is determined according to the desired magnification (magnification already set) (Step 1202), and when it is found at this time that the magnification is not to be changed (Step 1203), the desired step number of the lens is compared with the present position step number. If they are not in agreement with each other (Step 1204), when the desired step number of the lens is larger than the present position step number (Step 1501), the lens moves in the direction of the scale of enlargement, or the direction of the arrow B, by a single step (Step 1502), and the present position step of the lens is added by a single step (Step 1503). Then, the routine returns to Step 1203, and unless the magnification is changed, the lens is moved in the direction corresponding to the scale of enlargement. When the present position step of the lens reaches the desired step (Step 1204), the desired step number of the mirror moved by the mirror motor 27 is determined according to the desired magnification (Step 1301). When a further new magnification is not inputted at this time (Step 1302), the desired step number of the mirror and the present position step number are compared (Step 1303). When the desired step number is larger than the present step number (Step 1304), the mirror is moved in the direction off the home position (the direction of the arrow B) by a single step (Step 1305), and the present position step number of the mirror is added by a single step (Step 1306). When the desired step number is smaller than the present position step number at Step 1304, the mirror moves in the direction of the arrow A by a single step (Step 1307), and the present position step number of the mirror is subtracted by a single step (Step 1308). The routine returns to Step 1302, and unless the magnification is changed, the mirror moves towards the desired position. When the present position step number of the mirror is in agreement with the desired position step number (Step 1303), the movements of the lens and mirror are completed. When the newly set magnification is smaller than the present magnification at Step 1201, the desired step number of the mirror is determined according to the desired magnification (magnification already set) (Step 1205), and if the magnification is not further changed at this time (Step 1206), the desired step number of the mirror and the present position step number are compared. If they are not in agreement with each other (Step 1207), the mirror moves in the direction corresponding to the equivalent scale, or the direction of the arrow B, by a single step when the desired step number of the mirror is larger than the present position step number (Step 1602), and the present position step number of the mirror is added by a single step (Step 1603). When the desired step number of the mirror is smaller than the present position step number at Step 1601, the mirror moves in the direction of the arrow A by a single step (Step 1604), and the present position step number of the mirror is subtracted by a single step. Then, the routine returns to Step 1206, and unless the magnification is changed, the mirror continues moving. When the desired step number of the mirror is in agreement with the present position step number (Step 1207), the desired step number of the lens is determined according to the desired magnification (magnification already set) (Step 1401). If the magnification is not changed at this time (Step 1402), the desired step number of the lens and the present position step number are compared (Step 1403), and the lens moves in the direction corresponding to the scale of enlargement (the direction of the arrow B) when the desired step number of the lens is larger than the present position step number (Step 1405), and the present position step number of the lens is added by a single step (Step 1406). When the desired step number of the lens is smaller than the present position step number at Step 1404, the lens moves in the direction corresponding to the scale of reduction (the direction of the arrow A) by a single step (Step 1407), and the present position step number of the lens is subtracted by a single step (Step 1408). Then, the routine returns to Step 1402, and unless the magnification is further changed at this time, the lens continues moving. When the desired step number of the lens and the present position step number are in agreement with each other (Step 1403), the movements of the lens and mirror are completed. If the magnification is reset at each of Steps 1203, 1206 and 1402, when the reset magnification is fixed (at Step 1203*a*, 1206*a* or 1402*a*), the routine proceeds to Step 1208, and the current desired magnification and the reset magnification are compared with each other. When the current desired magnfication is larger then the reset magnification, the routine proceeds to Step 1205, but when the former is smaller than the latter, the routine proceeds to Step 1202.

The subroutine (initialization) will now be described in conjunction with flow charts shown in FIGS. 23 through 26. First, when the mirror is in its home position (Step 1701), the mirror is moved in the direction corresponding to the equivalent scale, or the direction of the arrow B, by 20 steps (Step 1702), and thereafter, the mirror is moved towards the home position (Step 1703). When the mirror is not in the home position at Step 1701, the mirror is moved towards the home position without any step (Step 1703). When the mirror reaches the home position (Step 1704), it is judged if the lens is in its home position (Step 1705). If so, the lens is moved in the direction corresponding to the scale of enlargement (the direction of the arrow B) by 20 steps (Step 1776), and thereafter, the lens is moved towards the home position again (Step 1707). When the lens is not in the home position at Step 1705, the lens is moved towards the home position without any step (Step 1707). When the lens reaches the home position (Step 1708), the present position step numbers of the mirror and lens are set at zero. Then, the desired step number of the lens is determined according to the desired magnification (magnification already set) (Step 1802). When the magnification is not changed at this time (Step 1803), the desired step number of the lens and the present position step number are compared with each other (Step 1806). When they are not in agreement with each other, the lens is moved by a single step (Step 1807), and the present position step number is added by a single step (Step 1808). After that, the routine returns to Step 1803. When the magnification is changed at Step 1803, after the magnification is fixed (Step 1804), the desired magnification is changed (Step 1805), and the routine returns to Step 1802. When the desired step number of the lens and the present position step number are in agreement with each other at Step 1806, the desired step number of the mirror is determined according to the desired magnification (magnification already set) (Step 1901). When the magnification is not changed at this time (Step 1902), the desired step number of the mirror and the present position step number are compared. When they are not in agreement with each other, the mirror is moved by a single step (1905), the present position step number of the mirror is added by a single step (Step 1906), and the routine returns to Step 1902. When the magnification is changed at Step 1902, after the magnification is fixed (Step 1903), the routine proceeds to Step 1208 in FIG. 16. When the desired step number of the mirror is in agreement with the present position step number at Step 1904, the initializations of the lens and mirror are completed.

Even if the magnification is changed while the lens 18 and the fourth and fifth mirrors 19, 20 are moving, they move to the appropriate positions corresponding to the magnification newly set, and hence, the period of time required for setting the magnification is shortened.

In this way, if the magnification is changed while the lens and mirror are moving for varying the magnification, the lens and mirror can move to their respective positions corresponding to the newly inputted magnification without any trouble, so that the period of time required for setting the magnification can be shortened.

What is claimed is:

1. An electrophotographic copying machine, comprising:

a contact glass plate on which an original sheet is set, an exposure lamp for scanning the original sheet on the contact glass plate;

a photoconductor;

a first mirror for reflecting the light emitted from the exposure lamp and then reflected by the original sheet, in the direction contrary to the scanning direction;

a second mirror for reflecting the light from the first mirror;

a third mirror for reflecting the light from the second mirror in the scanning direction;

a lens refracting the light from the third mirror for imaging on the photoconductor through a fourth mirror means;

a first moving frame movable in the scanning direction for carrying the exposure lamp and the first mirror;

a second moving frame movable following the first moving frame for carrying the second and third mirrors;

inputting means for inputting a desired copy magnification;

magnification setting means for setting the inputted magnification by moving the lens and fourth mirror means; and an optical system driving means for moving the first and second moving frames from their respective home positions, when the original sheet is scanned, to keep a fixed optical length from the face of the original sheet to the lens corresponding to the copy magnification;

means for controlling said magnification setting means such that when a magnification is newly inputted while the lens and fourth mirror means are moving corresponding to the magnification previously inputted, the magnification setting means moving the lens first when the magnification newly inputted is larger than the magnification previously inputted, but moving the fourth mirror means first when the magnification newly inputted is smaller than the magnification previously inputted.

2. A copying machine according to claim 1, wherein said fourth mirror means comprises at least two mirrors for varying an optical length from the imaging lens to the photoconductor.

3. A method of setting a copy magnification in an electrophotographic copying machine, where with a fixed optical length from an original sheet to a lens, the light reflected by the original sheet traverses an imaging lens and a magnification setting mirror means to perform imaging on a photoconductor, comprising the steps of fixing an optical length between the lens and the photoconductor by moving the imaging lens and the magnification setting mirror means corresponding to an inputted copy magnification;

when another magnification is newly inputted while the imaging lens and the magnification setting mirror means are moving corresponding to the magnification previously inputted, moving the imaging lens first when the magnification newly inputted is larger than the magnification previously inputted, but moving the magnification setting mirror means first when the magnification newly inputted is equivalent to or smaller than the magnification previously inputted, so as to effect the magnification newly inputted.

4. A method of setting a copy magnification in an electrophotographic copying machine according to claim 3, wherein said magnification setting mirror means comprises at least two mirrors to vary the optical length from the imaging lens to the photoconductor.

* * * * *